US010553094B2

(12) United States Patent
Perreau

(10) Patent No.: US 10,553,094 B2
(45) Date of Patent: Feb. 4, 2020

(54) SUBSTANCE RELEASE BENEFIT DENIAL SECURITY DEVICE

(71) Applicant: CHECKPOINT SYSTEMS, INC., Thorofare, NJ (US)

(72) Inventor: Benoit Perreau, Weddington, NC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 0 days.

(21) Appl. No.: 16/202,181

(22) Filed: Nov. 28, 2018

(65) Prior Publication Data

US 2019/0164398 A1 May 30, 2019

Related U.S. Application Data

(60) Provisional application No. 62/591,371, filed on Nov. 28, 2017.

(51) Int. Cl.

| | |
|---|---|
| ***G08B 13/24*** | (2006.01) |
| ***G08B 3/10*** | (2006.01) |
| ***B65D 43/16*** | (2006.01) |
| ***B65D 51/24*** | (2006.01) |

(52) U.S. Cl.

CPC ..... *G08B 13/2462* (2013.01); *B65D 43/16* (2013.01); *B65D 51/248* (2013.01); *G08B 3/10* (2013.01); *G08B 13/2434* (2013.01)

(58) Field of Classification Search

CPC .. G08B 13/2462; G08B 3/10; G08B 13/2434; B65D 43/16; B65D 51/248

See application file for complete search history.

(56) References Cited

U.S. PATENT DOCUMENTS 4,559,529 A * 12/1985 Bernhardt ..... G08B 13/2431 340/568.7
5,031,287 A * 7/1991 Charlot, Jr. ..... E05B 73/0017 24/703.1
5,410,295 A * 4/1995 Van Lint ..... G07F 9/02 340/309.16

(Continued)

OTHER PUBLICATIONS

International Search Report and Written Opinion for International Application No. PCT/US2018/052188 dated Nov. 27, 2018; 55 pages.

*Primary Examiner* — Joseph H Feild
*Assistant Examiner* — Rufus C Point
(74) *Attorney, Agent, or Firm* — McDonald Hopkins LLC

(57) ABSTRACT

Apparatuses and methods associated with a substance release benefit denial security device are provided. One example security device includes a locking assembly to releasably affix the security device to an article, and an electronic assembly. The electronic assembly may include a radio frequency receiver and processing circuitry. The security device may also include a benefit denial assembly, which includes a substance disposed in a vessel and a release mechanism configured to release the substance into or onto an article. The processing circuitry may be configured to receive a gate detected signal from the radio frequency receiver in response to the radio frequency receiver receiving a wireless signal, and in response to receiving the gate detected signal from the radio frequency receiver, transmit a release signal to the release mechanism to trigger the release mechanism to release the substance.

32 Claims, 23 Drawing Sheets

(56) References Cited

U.S. PATENT DOCUMENTS 5,448,223 A * 9/1995 Johnson ..... G08B 13/2431 109/29
5,734,325 A * 3/1998 Johnson ..... G08B 15/02 340/545.6
5,790,409 A * 8/1998 Fedor ..... G06M 7/04 700/214
5,952,920 A * 9/1999 Braddick ..... G08B 15/02 109/2
7,194,879 B2 3/2007 Sedon
7,204,425 B2 * 4/2007 Mosher, Jr. ..... G06K 19/04 235/492
7,598,861 B2 10/2009 Belden
7,652,574 B2 * 1/2010 Sayegh ..... E05B 73/0017 340/568.1
7,963,131 B2 6/2011 Zhang
7,990,273 B2 * 8/2011 Handyside ..... G08B 15/02 340/506
7,992,259 B2 8/2011 Goldstein et al.
8,704,665 B2 * 4/2014 Yang ..... E05B 73/0017 340/539.1
8,833,115 B2 9/2014 Nakasuji
9,324,015 B2 * 4/2016 Wu ..... G06K 19/06
9,336,665 B2 * 5/2016 Yang ..... G08B 13/14
9,672,711 B2 6/2017 Niederhuefner
9,734,445 B2 8/2017 Pachler
2003/0122673 A1 7/2003 Anderson
2006/0145848 A1 7/2006 Marsilio
2006/0238347 A1 * 10/2006 Parkinson ..... G08B 13/1436 340/572.4
2007/0024448 A1 * 2/2007 Sayegh ..... E05B 73/0017 340/572.1
2008/0156764 A1 * 7/2008 Necchi ..... B65D 50/067 215/201
2009/0058659 A1 * 3/2009 Handyside ..... E05B 73/0017 340/572.9
2009/0135014 A1 * 5/2009 Bleckmann ..... G08B 13/2434 340/572.8
2010/0315238 A1 * 12/2010 Yang ..... E05B 73/0017 340/572.9
2012/0019385 A1 * 1/2012 Brodzik ..... G08B 13/2434 340/572.9
2012/0206263 A1 * 8/2012 Yang ..... G08B 3/10 340/572.8
2012/0247373 A1 10/2012 Van Dessel
2013/0135104 A1 * 5/2013 Nikkanen ..... G06K 19/07372 340/572.1
2015/0145680 A1 * 5/2015 Favier ..... E05B 73/0017 340/572.9
2019/0012632 A1 * 1/2019 Favier ..... G06K 19/07758

* cited by examiner

SUBSTANCE RELEASE BENEFIT DENIAL SECURITY DEVICE

CROSS-REFERENCE TO RELATED APPLICATIONS

The present application claims priority to U.S. Provisional Patent Application 62/591,371 filed on Nov. 28, 2017, the entire disclosure of which is incorporated herein by reference in its entirety.

TECHNICAL FIELD

Example embodiments described herein generally related to security technology, and more particularly, relate to a security device for use in retail loss prevention.

BACKGROUND

Product security devices are commonly used in a number of settings, including in retail theft prevention. In this regard, retail theft prevention systems, often referred to as electronic article surveillance (EAS) systems, use antennas located at the exits of a retail establishment to detect radio frequency (RF) or magnetic (AM) signals emitted by a security device that is coupled to items for sale. A product security device may be affixed or locked to or around a product, and if the device is not removed at a point-of-sale during a sales transaction, the security device will be detected by the EAS system as the device, which is affixed to the product, leaves the store. An alarm may be triggered because the removal of the device from the retail establishment is likely to be associated with an attempted theft. However, if a thief should manage to remove a product from a retail establishment, despite the alarms, the thief may be able to use tools or more complex techniques to remove the security device from the product without damaging the product, thereby permitting the stolen product to be used or resold.

SUMMARY OF SOME EXAMPLES

According to some example embodiments, a security device is provided. The example security device may comprise a container. The container is configured to receive an article within the container. The security device may further comprise a locking assembly affixed to the container. The locking assembly may be configured to lock the container to inhibit access to the article and separation of the article from the security device. The locking assembly may be configured to permit the container to be unlocked to permit access to the article. The security device may also include an electronic assembly affixed to the container. The electronic assembly may comprise a radio frequency receiver and processing circuitry. The processing circuitry may be coupled to the radio frequency receiver. Further, the security device may comprise a benefit denial assembly comprising a vessel and a release mechanism. The vessel may comprise a substance disposed within the vessel. The release mechanism may be configured to release the substance into the container and onto the article disposed therein. The release mechanism may be coupled to and triggerable by the processing circuitry. The processing circuitry may be configured to receive a gate detected signal from the radio frequency receiver in response to the radio frequency receiver receiving a wireless signal and, in response to receiving the gate detected signal from the radio frequency receiver, transmit a release signal to the release mechanism to trigger the release mechanism to release the substance.

According to some example embodiments, an example method is provided. The example method may comprise receiving, at processing circuitry of an electronic assembly of a security device, a gate detected signal from a radio frequency receiver of the electronic assembly in response to the radio frequency receiver receiving a wireless signal, and, in response to receiving the gate detected signal from the radio frequency receiver, transmitting a release signal to a release mechanism of a benefit denial assembly to trigger the release mechanism to release a substance disposed within a vessel of the benefit denial assembly into a lockable container, wherein an article is disposed within the lockable container.

According to some example embodiments, another security device is provided. The security device may comprise a locking assembly configured to lock the security device to inhibit separation of the security device from an article and configured to unlock the security device from the article to permit the article to be separated from the security device without sounding an alarm. The security device may further comprise an electronic assembly comprising a radio frequency receiver, and processing circuitry. The processing circuitry may be coupled to the radio frequency receiver. The security device may further comprise a benefit denial assembly comprising a vessel and a release mechanism. A substance may be disposed within the vessel. The release mechanism may be configured to release the substance into or onto the article. The release mechanism may be coupled to and triggerable by the processing circuitry. The processing circuitry may be configured to receive a gate detected signal from the radio frequency receiver in response to the radio frequency receiver receiving a wireless signal, and, in response to receiving the gate detected signal from the radio frequency receiver, transmit a release signal to the release mechanism to trigger the release mechanism to release the substance.

An example method is also provided in accordance with some example embodiments. The method may comprise receiving, at processing circuitry of an electronic assembly of a security device, a gate detected signal from a radio frequency receiver of the electronic assembly in response to the radio frequency receiver receiving a wireless signal, and, in response to receiving the gate detected signal from the radio frequency receiver, transmitting a release signal to a release mechanism of a benefit denial assembly to trigger the release mechanism to release a substance disposed within a vessel of the benefit denial assembly into or onto an article that is locked to the security device.

In one aspect provided is a security device comprising:

- a locking assembly configured to lock the security device to inhibit separation of the security device from an article and configured to unlock the security device from the article to permit the article to be separated from the security device without sounding an alarm;
- an electronic assembly comprising:
  - a radio frequency receiver; and
  - processing circuitry, the processing circuitry being coupled to the radio frequency receiver;
- a benefit denial assembly comprising:
  - a vessel, wherein a substance is disposed within the vessel;
  - a release mechanism configured to release the substance into or onto the article, the release mechanism being coupled to and triggerable by the processing circuitry;

wherein the processing circuitry is configured to:

receive a gate detected signal from the radio frequency receiver in response to the radio frequency receiver receiving a wireless signal; and in response to receiving the gate detected signal from the radio frequency receiver, transmit a release signal to the release mechanism to trigger the release mechanism to release the substance.

In one embodiment, the electronic assembly further comprises an audio device, and wherein the processing circuitry is configured to, in response to receiving the gate detected signal from the radio frequency receiver, transmit an alarm signal to the audio device to cause the audio device to emit an alarm sound.

In one embodiment, the substance is a liquid, a gel, a powder, or an expanding foam.

In one embodiment, the processing circuitry is further configured to, in response to receiving the gate detected signal from the radio frequency receiver, commence a timer; and wherein the processing circuitry is configured to transmit the release signal to the release mechanism in response to receiving the gate detected signal from the radio frequency receiver and the timer reaching a threshold value.

In one embodiment, the processing circuitry is further configured to receive a disarm signal, and in response to receiving the disarm signal, stop the timer.

In one embodiment, the locking assembly includes a switch configured to actuate into an unlocked position in association with application of a key to generate a disarm signal in response to the locking assembly transitioning into an unlocked state.

In one embodiment, the switch of the locking mechanism is configured to send an alarm signal in response to actuation of the switch that is not in association with application of the key.

In one embodiment, the electronic assembly comprises a second radio frequency receiver, and wherein the disarm signal is provided by the second radio frequency receiver in response to receiving a wireless disarm signal.

In one embodiment, the electronic assembly further comprises an audio device; and wherein the processing circuitry is configured to: in response to receiving the gate detected signal from the radio frequency receiver, transmit an alarm signal to the audio device to cause the audio device to emit an alarm sound; and in response to receiving the disarm signal, transmit a stop alarm signal to the audio device to cause the audio device to discontinue emitting the alarm sound.

In one embodiment, the radio frequency receiver comprises an inductor and a capacitor coupled to form a resonant circuit.

In one embodiment, the resonant circuit is configured to resonate at about 58 kHz or about 8.2 MHz.

In another aspect, provided is a security device comprising:

an electronic assembly comprising:

a radio frequency receiver; and processing circuitry, the processing circuitry being coupled to the radio frequency receiver;

a benefit denial assembly comprising:

a vessel, wherein a substance is disposed within the vessel;

a release mechanism configured to release the substance into or onto the article, the release mechanism being coupled to and triggerable by the processing circuitry;

wherein the processing circuitry is configured to:

receive a gate detected signal from the radio frequency receiver in response to the radio frequency receiver receiving a wireless signal; and in response to receiving the gate detected signal from the radio frequency receiver, transmit a release signal to the release mechanism to trigger the release mechanism to release the substance; and wherein the electronic assembly is disposed within a housing, the security device comprising a locking assembly configured to lock the security device to inhibit separation of the security device from an article and configured to unlock the security device from the article to permit the article to be separated from the security device without sounding an alarm, the locking assembly comprising (i) a pin lock disposed within the housing and a pin that is releasably engagable with the pin lock; or (ii) a clamp suitable to apply a clamping force to hold the housing against a surface of an article.

In one embodiment, the security device comprises an opening in the housing, the opening in communication with the vessel and through which the substance be released.

In one embodiment, the release mechanism comprises a pin and a mechanical actuator, wherein upon receiving a release signal, the mechanical actuator moves the pin to pierce the vessel and form an orifice in the vessel allowing the substance to be released from the vessel.

In one embodiment, the release mechanism comprises a pump comprising a reactant, wherein upon receiving a release signal, the pump sprays the reactant onto the vessel to form an orifice in the vessel allowing the substance to be released from the vessel.

In one embodiment, the release mechanism comprises an actuator that, upon receiving a release signal, is actuated to apply a pressure on the surface of the vessel thereby forcing the substance out of the vessel.

In one embodiment, the actuator is a piston.

In one embodiment, the release mechanism comprises a tube in fluid communication with the vessel and the substance flows from the vessel through the tube.

In one embodiment, the release mechanism comprises a nozzle affixed to the vessel, wherein upon the actuator being actuated to apply a pressure to the vessel, the substance is forced out of the vessel and out of the nozzle.

In one embodiment, the vessel comprises two or more compartments and a barrier disposed between each of the two or compartments, each compartment comprising a sub-component substance, wherein upon receipt of a release signal, the barriers between the two or compartments is opened to permit mixing of the sub-component substances.

In one embodiment, the electronic assembly further comprises an audio device, and wherein the processing circuitry is configured to, in response to receiving the gate detected signal from the radio frequency receiver, transmit an alarm signal to the audio device to cause the audio device to emit an alarm sound.

In one embodiment, the substance is a liquid, a gel, a powder, or an expanding foam.

In one embodiment, the processing circuitry is further configured to, in response to receiving the gate detected signal from the radio frequency receiver, commence a timer; and wherein the processing circuitry is configured to transmit the release signal to the release mechanism in response to receiving the gate detected signal from the radio frequency receiver and the timer reaching a threshold value.

In one embodiment, the processing circuitry is further configured to receive a disarm signal, and in response to receiving the disarm signal, stop the timer.

In one embodiment, the locking assembly includes a switch configured to actuate into an unlocked position in association with application of a key to generate a disarm signal in response to the locking assembly transitioning into an unlocked state.

In one embodiment, the switch of the locking mechanism is configured to send an alarm signal in response to actuation of the switch that is not in association with application of the key.

In one embodiment, the electronic assembly comprises a second radio frequency receiver, and wherein the disarm signal is provided by the second radio frequency receiver in response to receiving a wireless disarm signal.

In one embodiment, the electronic assembly further comprises an audio device; and wherein the processing circuitry is configured to: in response to receiving the gate detected signal from the radio frequency receiver, transmit an alarm signal to the audio device to cause the audio device to emit an alarm sound; and in response to receiving the disarm signal, transmit a stop alarm signal to the audio device to cause the audio device to discontinue emitting the alarm sound.

In another aspect, provided is a method comprising: receiving, at processing circuitry of an electronic assembly of a security device, a gate detected signal from a radio frequency receiver of the electronic assembly in response to the radio frequency receiver receiving a wireless signal; and in response to receiving the gate detected signal from the radio frequency receiver, transmitting a release signal to a release mechanism of a benefit denial assembly to trigger the release mechanism to release a substance disposed within a vessel of the benefit denial assembly into or onto an article that is locked to the security device.

In one embodiment, the method further comprises transmitting an alarm signal to the audio device to cause the audio device to emit an alarm sound, in response to receiving the gate detected signal from the radio frequency receiver.

In one embodiment, the method further comprises commencing a timer, in response to receiving the gate detected signal from the radio frequency receiver; and wherein transmitting the release signal comprises transmitting the release signal to the release mechanism in response to receiving the gate detected signal from the radio frequency receiver and the timer reaching a threshold value.

In one embodiment, the substance is a liquid, a gel, a powder, or an expanding foam.

In still another aspect, provided is a security device comprising:

a container, wherein the container is configured to receive an article within the container;

a locking assembly affixed to the container, the locking assembly being configured to lock the container to inhibit access to the article and unlock the container to permit access to the article;

an electronic assembly affixed to the container, the electronic assembly comprising:

a radio frequency receiver; and processing circuitry, the processing circuitry being coupled to the radio frequency receiver;

a benefit denial assembly comprising:

a vessel, wherein a substance is disposed within the vessel;

a release mechanism configured to release the substance into the container, the release mechanism being coupled to and triggerable by the processing circuitry;

wherein the processing circuitry is configured to:

receive a gate detected signal from the radio frequency receiver in response to the radio frequency receiver receiving a wireless signal; and in response to receiving the gate detected signal from the radio frequency receiver, transmit a release signal to the release mechanism to trigger the release mechanism to release the sub stance.

In one embodiment, the electronic assembly further comprises an audio device, and wherein the processing circuitry is configured to, in response to receiving the gate detected signal from the radio frequency receiver, transmit an alarm signal to the audio device to cause the audio device to emit an alarm sound.

In one embodiment, the substance is chosen from a liquid, a gel, a powder, or an expanding foam.

In one embodiment, the processing circuitry is further configured to, in response to receiving the gate detected signal from the radio frequency receiver, commence a timer; and wherein the processing circuitry is configured to transmit the release signal to the release mechanism in response to receiving the gate detected signal from the radio frequency receiver and the timer reaching a threshold value.

In one embodiment, the processing circuitry is further configured to receive a disarm signal, and in response to receiving the disarm signal, stop the timer.

In one embodiment, the locking assembly includes a switch configured to actuate into an unlocked position and provide the disarm signal in response to the locking assembly transitioning into an unlocked state.

In one embodiment, the switch of the locking mechanism is configured to send an alarm signal in response to actuation of the switch that is not in association with application of the key.

In one embodiment, the electronic assembly comprises a second radio frequency receiver, and wherein the disarm signal is provided by the second radio frequency receiver in response to receiving a wireless disarm signal.

the electronic assembly further comprises an audio device; and wherein the processing circuitry is configured to: in response to receiving the gate detected signal from the radio frequency receiver, transmit an alarm signal to the audio device to cause the audio device to emit an alarm sound; and in response to receiving the disarm signal, transmit a stop alarm signal to the audio device to cause the audio device to discontinue emitting the alarm sound.

In one embodiment, the radio frequency receiver comprises an inductor and a capacitor coupled to form a resonant circuit.

In one embodiment, the resonant circuit is configured to resonate at about 58 kHz or about 8.2 MHz.

In one embodiment, the container comprises a five-sided base hingedly affixed to a lid.

In one embodiment, the electronic assembly and the benefit denial assembly are affixed to the hinged lid.

In one embodiment, the five-sided shell is transparent.

In one embodiment, the locking assembly is configured to be transitioned to an unlocked state through interaction with a magnetic key.

In still yet another aspect, provided is a method comprising: receiving, at processing circuitry of an electronic assembly, a gate detected signal from a radio frequency receiver of the electronic assembly in response to the radio frequency receiver receiving a wireless signal; and in response to receiving the gate detected signal from the radio frequency receiver, transmitting a release signal to a release mechanism of a benefit denial assembly to trigger the release mechanism to release a substance disposed within a vessel of the benefit denial assembly into a lockable container, wherein an article is disposed within the lockable container.

In one embodiment, the method further comprises transmitting an alarm signal to the audio device to cause the audio device to emit an alarm sound, in response to receiving the gate detected signal from the radio frequency receiver.

In one embodiment, the method further comprises commencing a timer, in response to receiving the gate detected signal from the radio frequency receiver; and wherein transmitting the release signal comprises transmitting the release signal to the release mechanism in response to receiving the gate detected signal from the radio frequency receiver and the timer reaching a threshold value.

In one embodiment of the method, the container comprises a five-sided shell affixed to a hinged lid.

In one embodiment of the method, the electronic assembly and the benefit denial assembly are affixed to a hinged lid of the container.

In one embodiment of the method, the substance is a liquid, a gel, a powder, or an expanding foam.

BRIEF DESCRIPTION OF THE DRAWINGS

Figure 1:
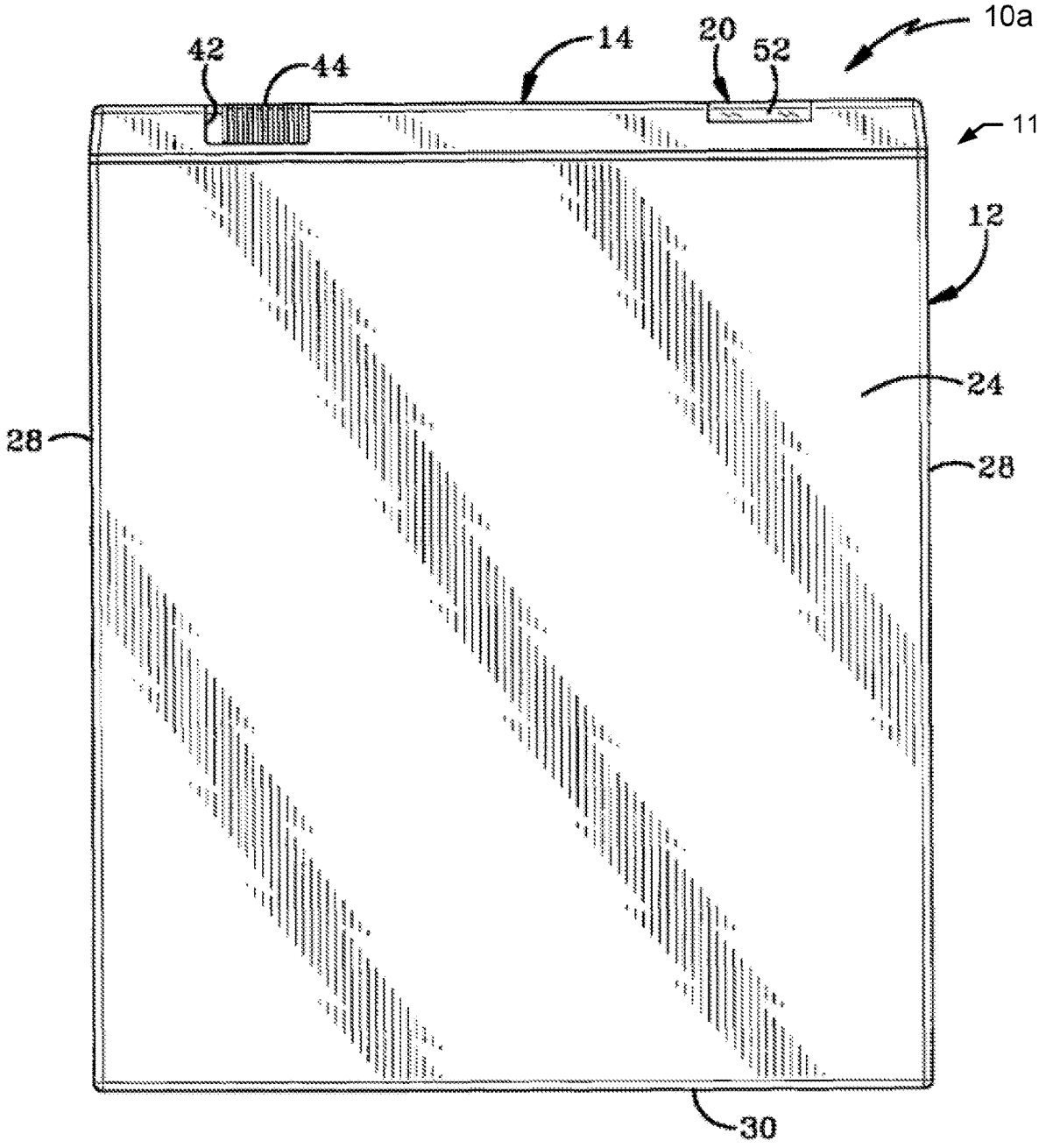
Figure 2:
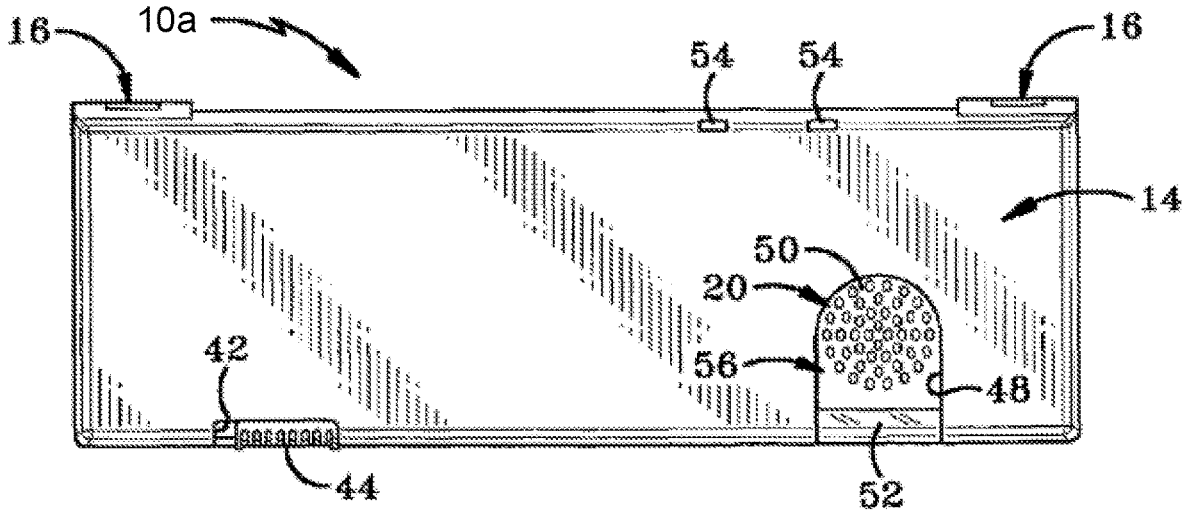
Figure 3:
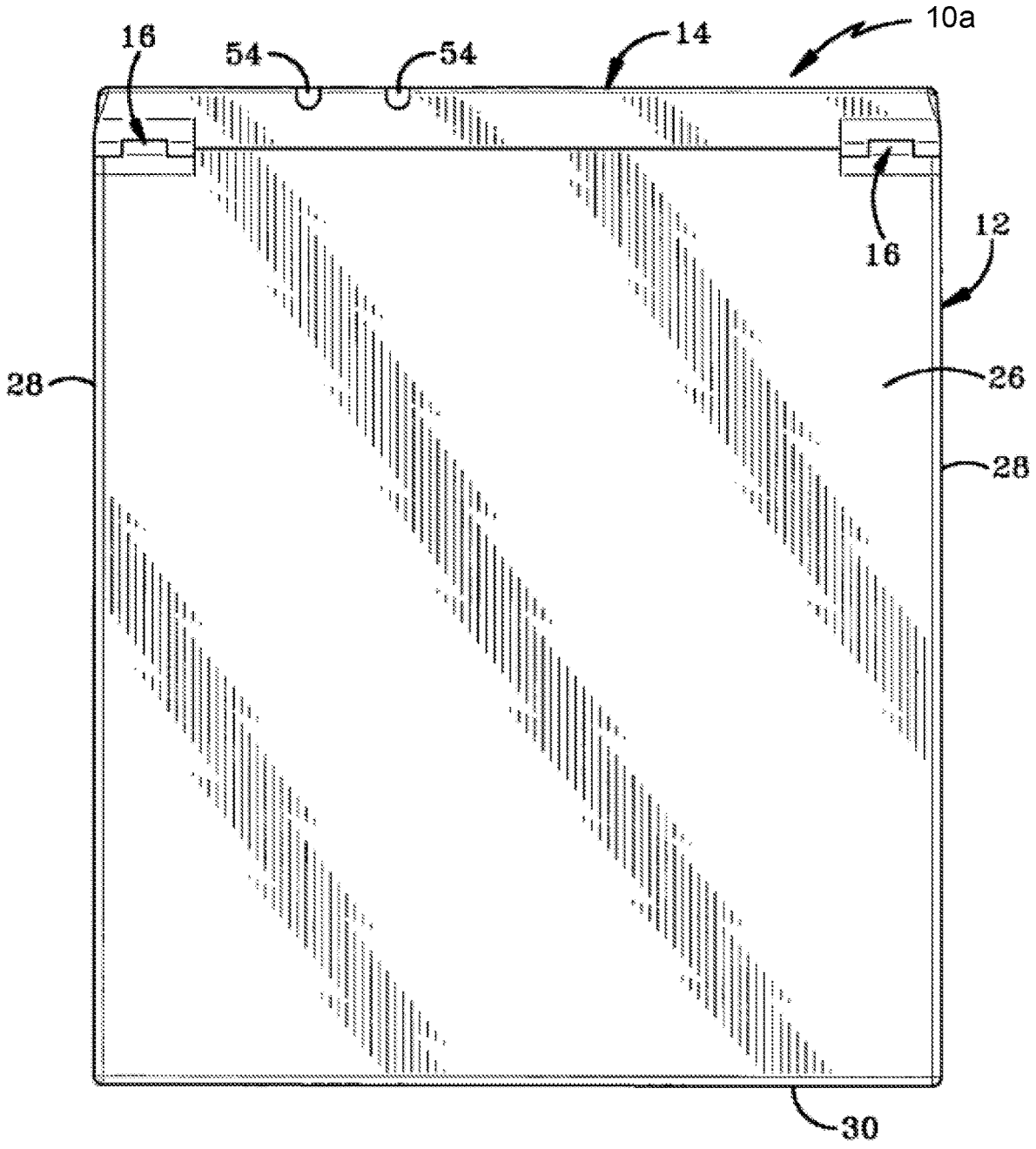
Figure 4:
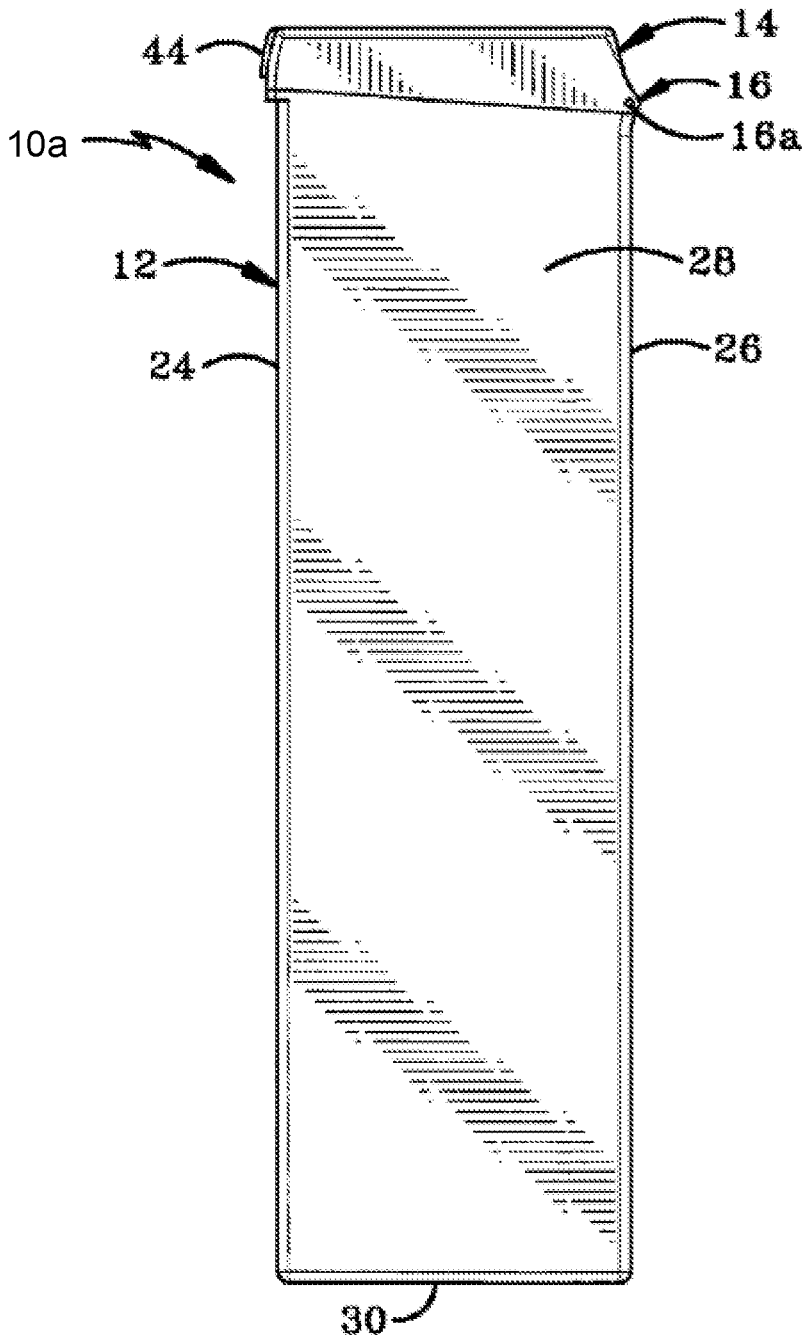
Figure 5:
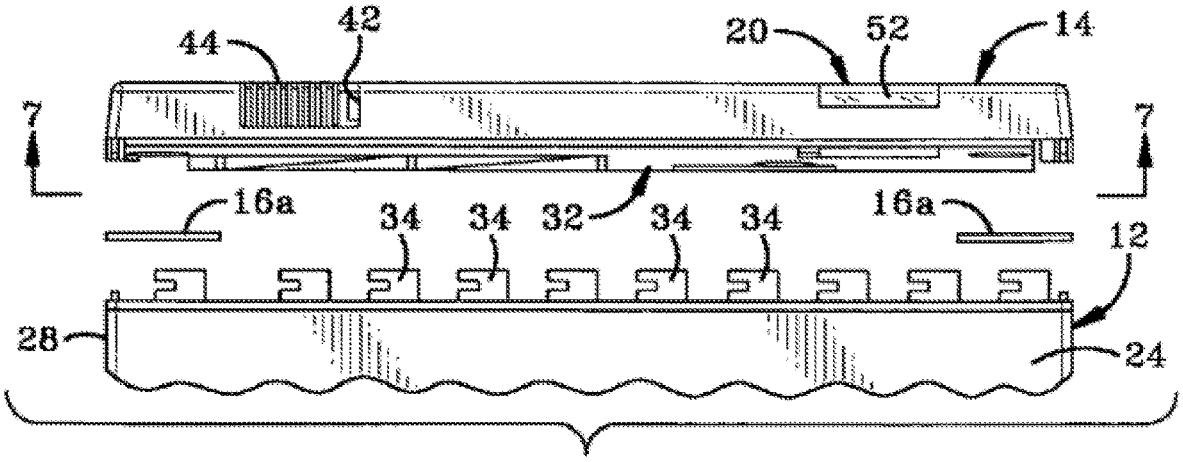
Figure 6:
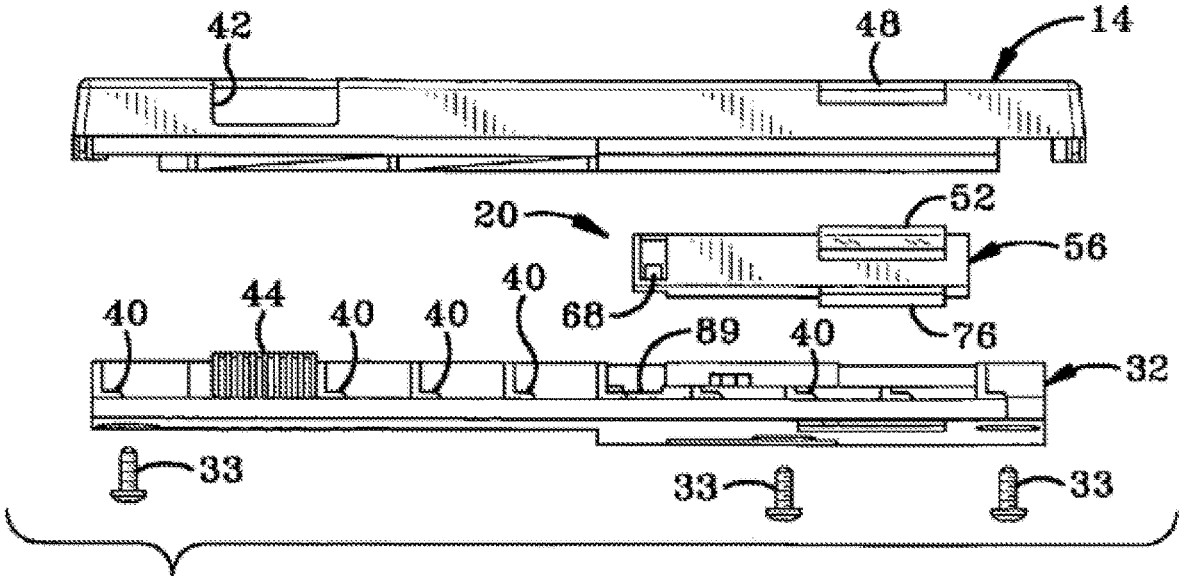
Figure 7:
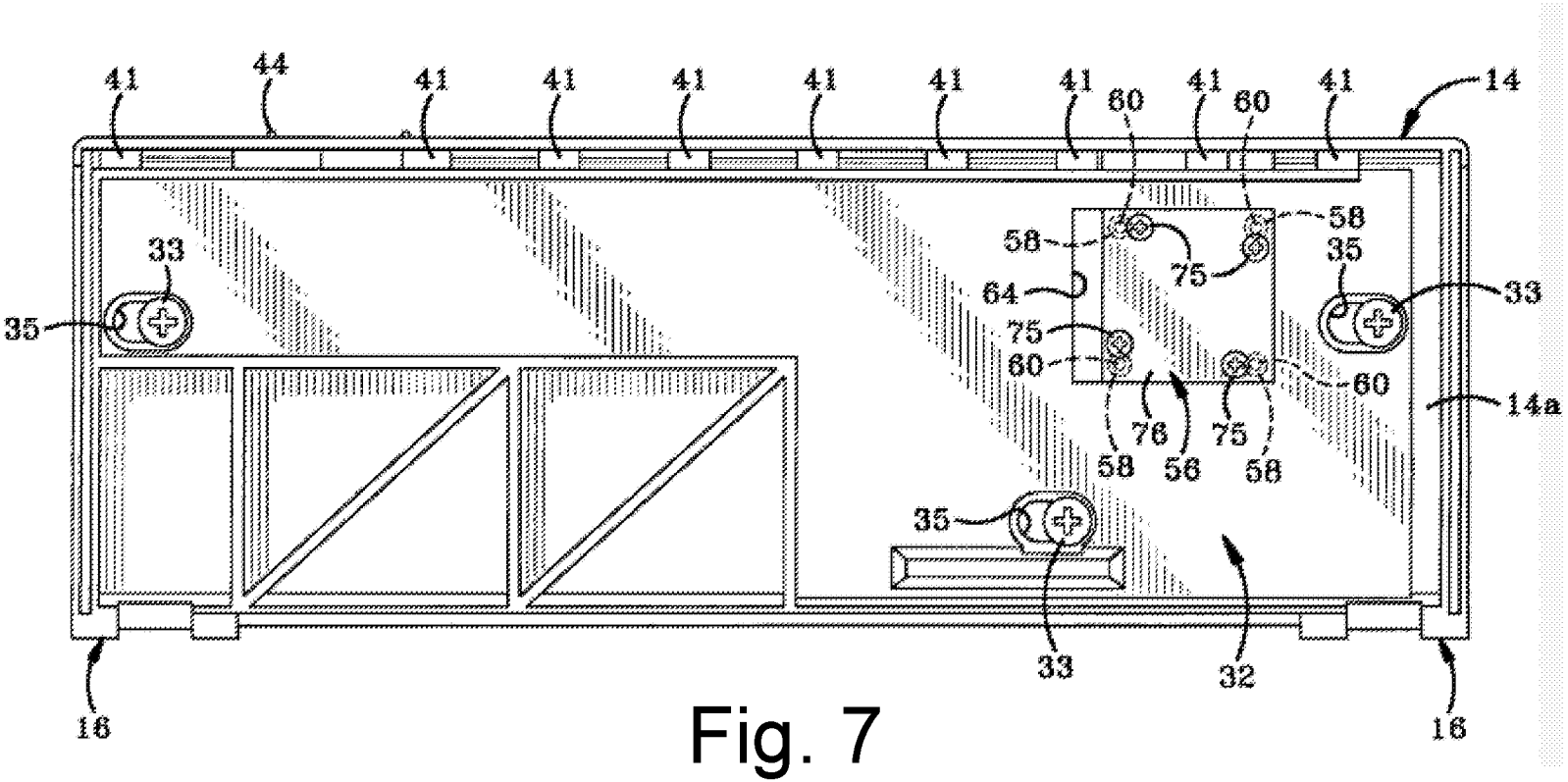
Figure 8:
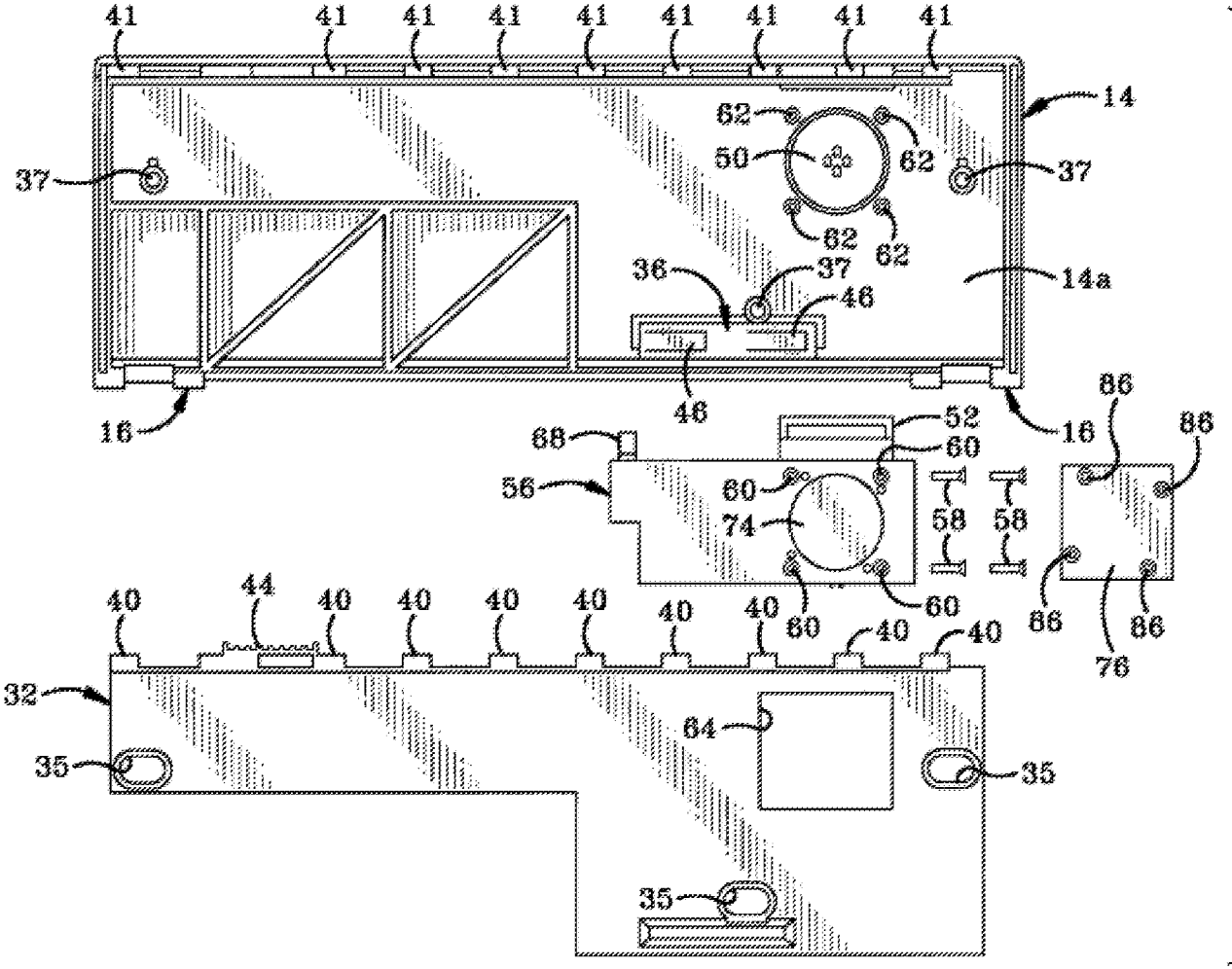
Figure 9:
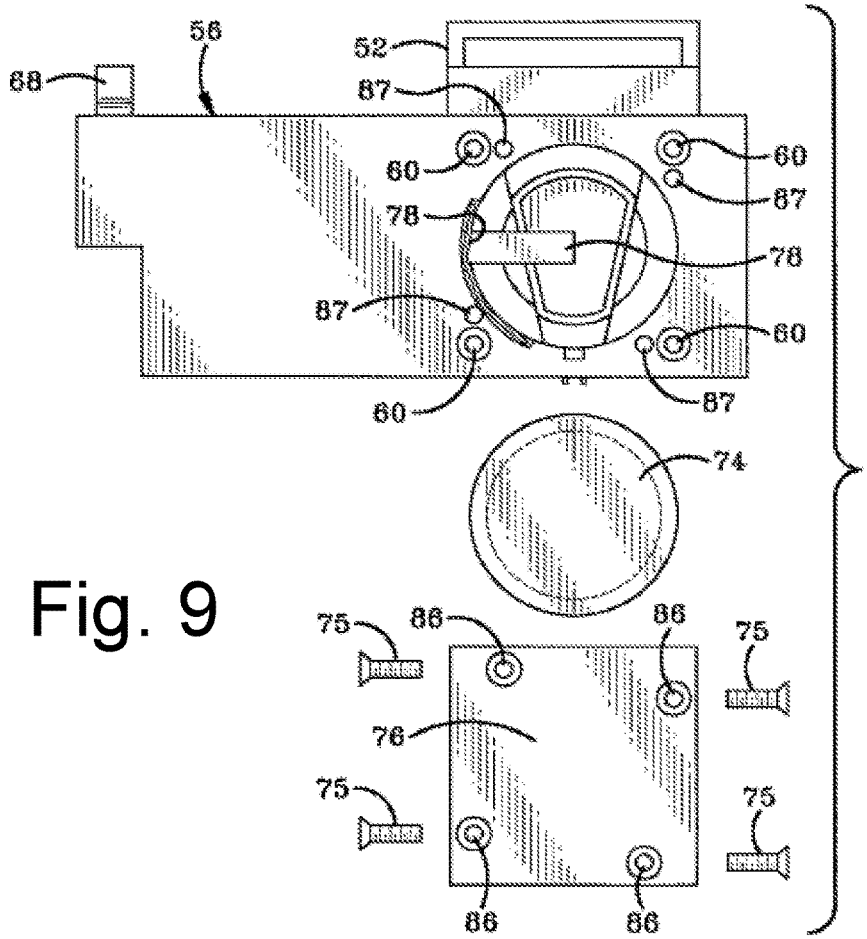
Figure 10:
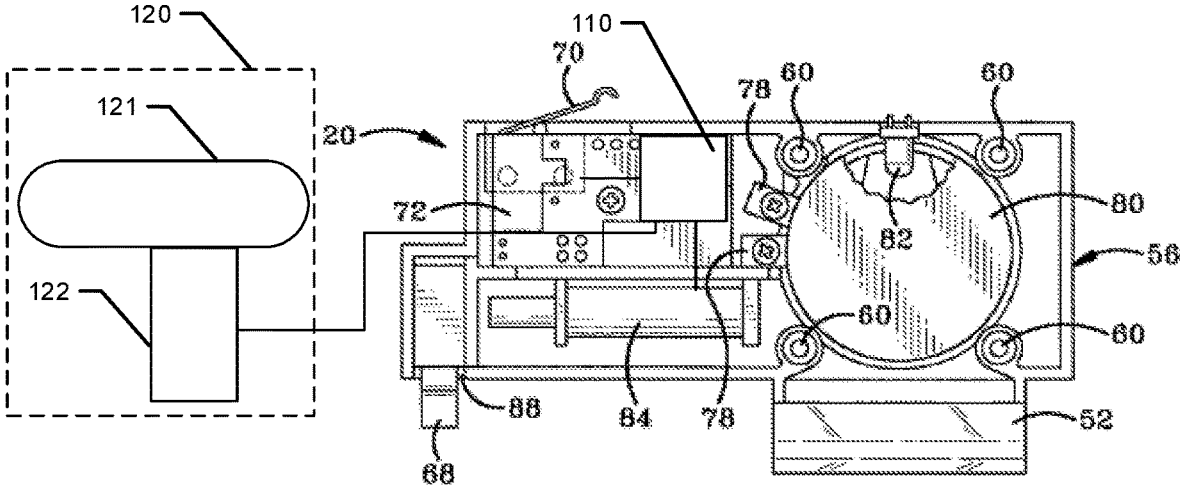
Figure 11:
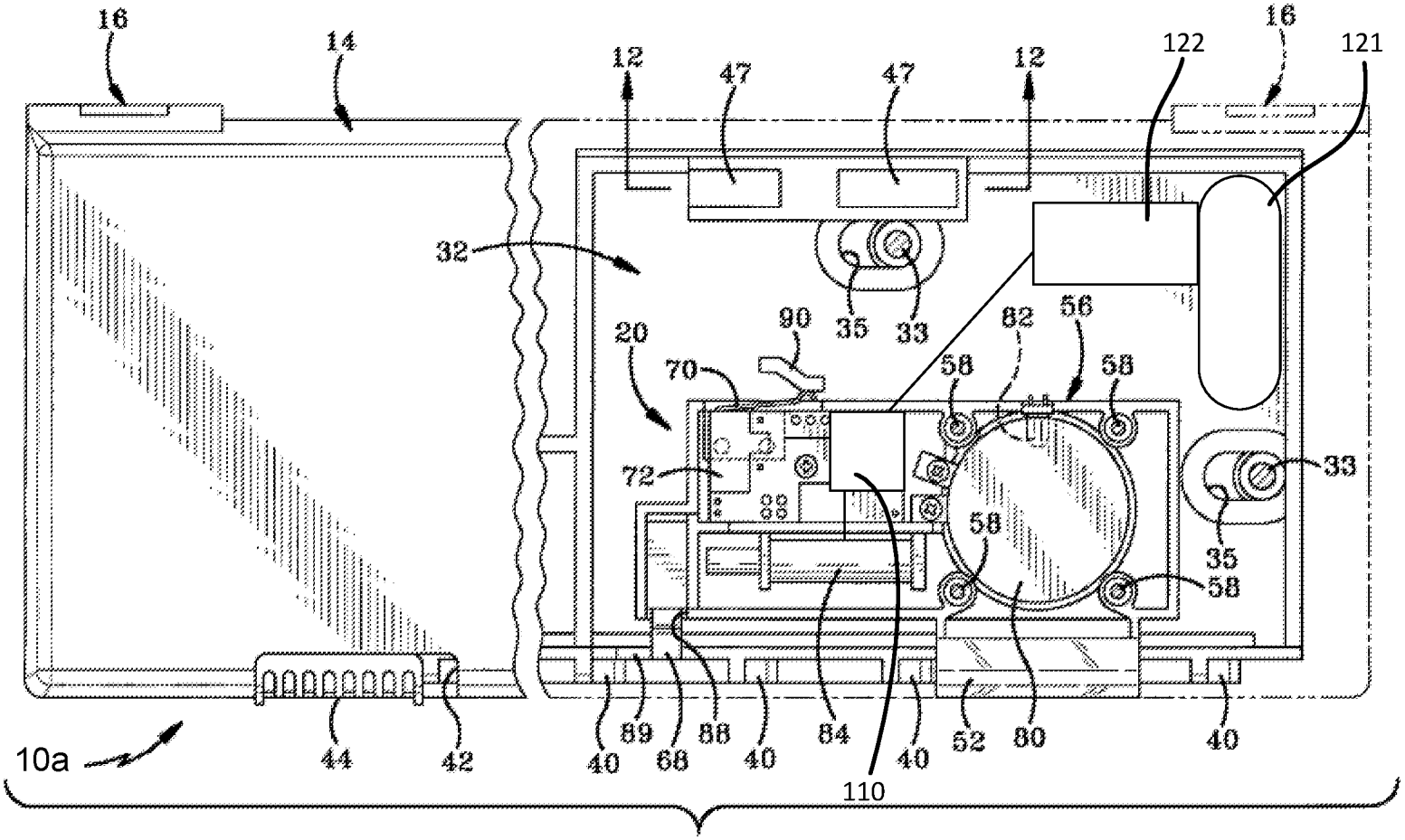
Figure 12:
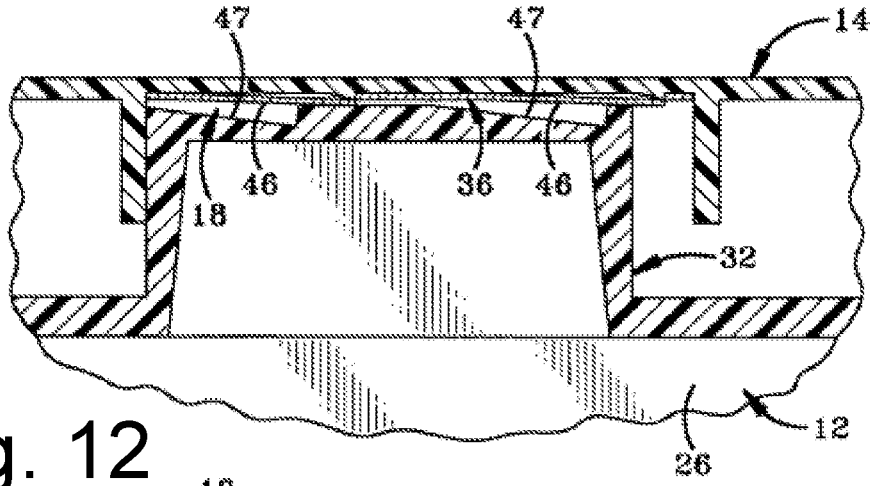
Figure 14:
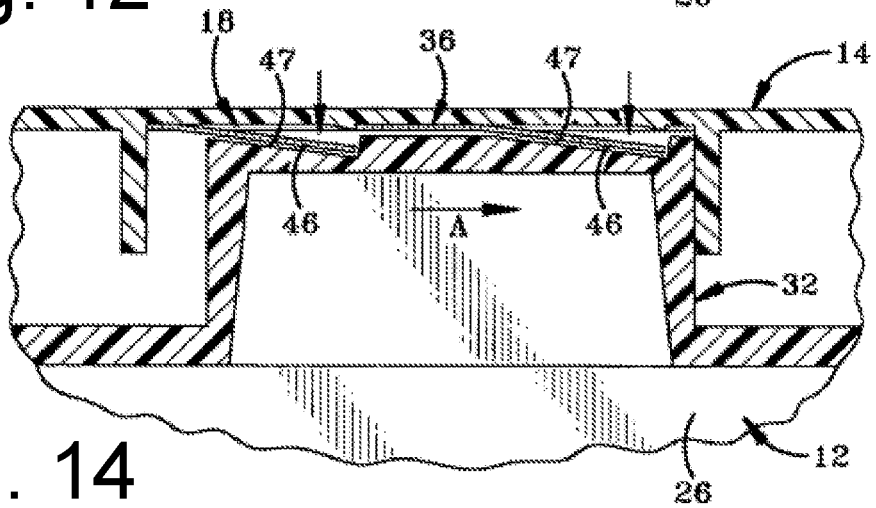
Figure 16:
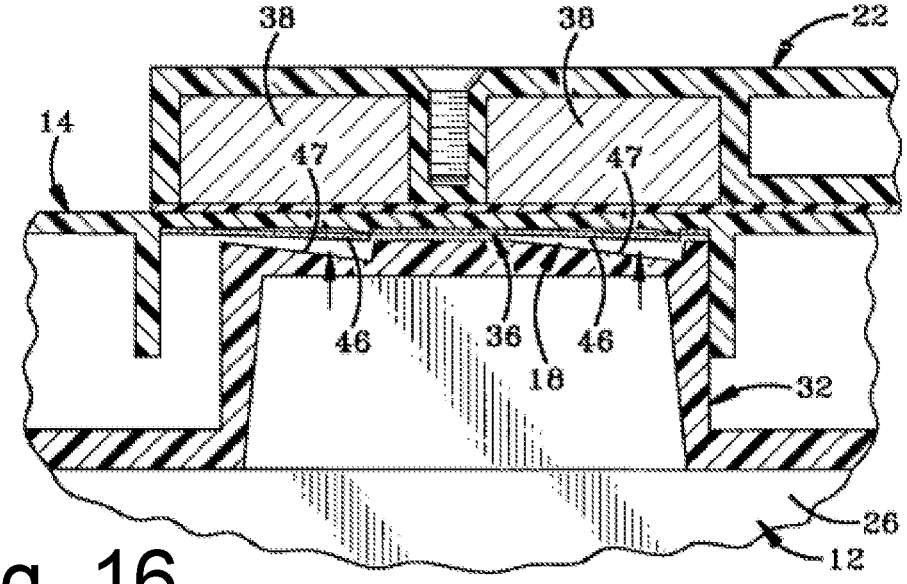
Figure 13:
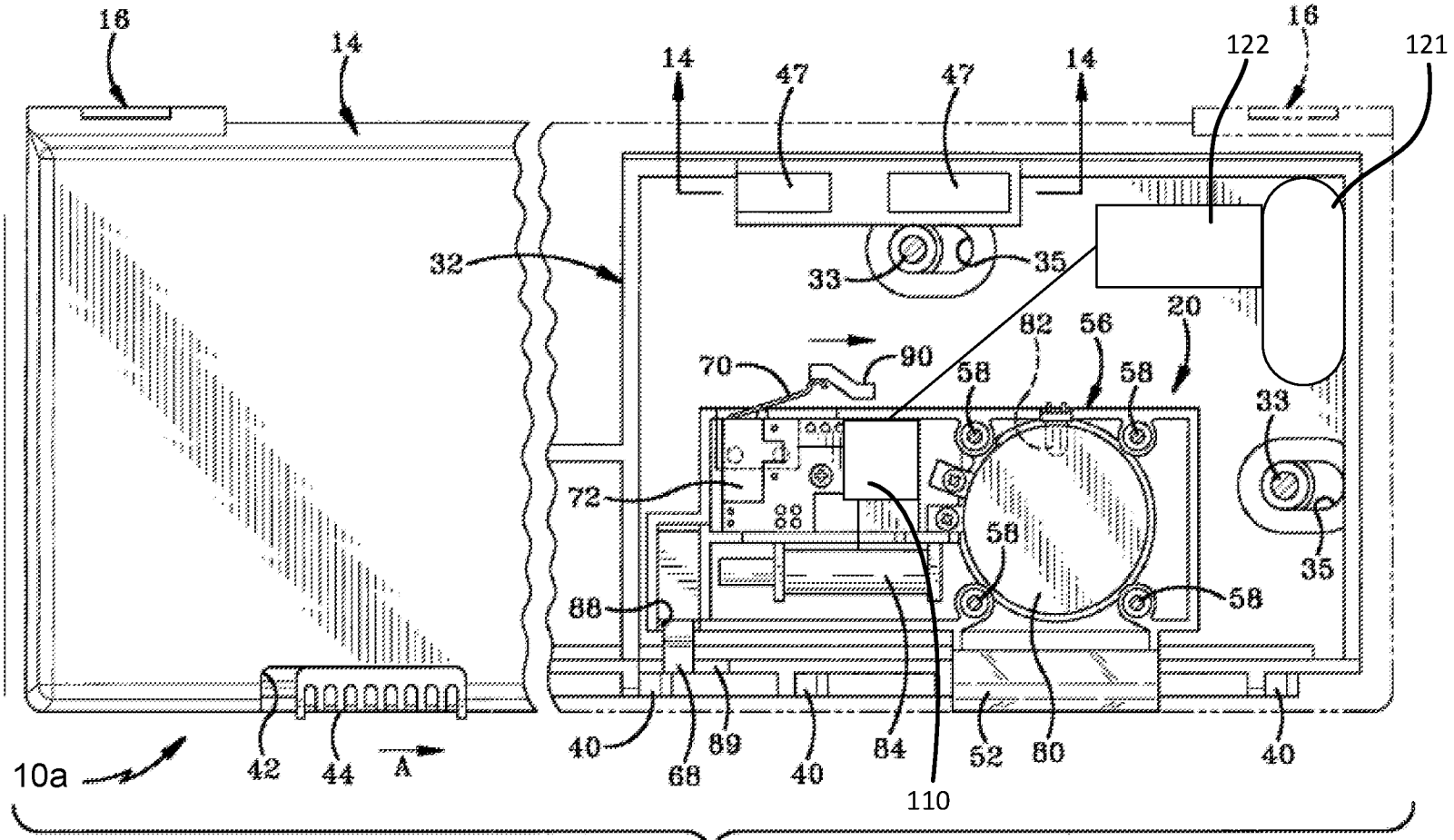
Figure 15:
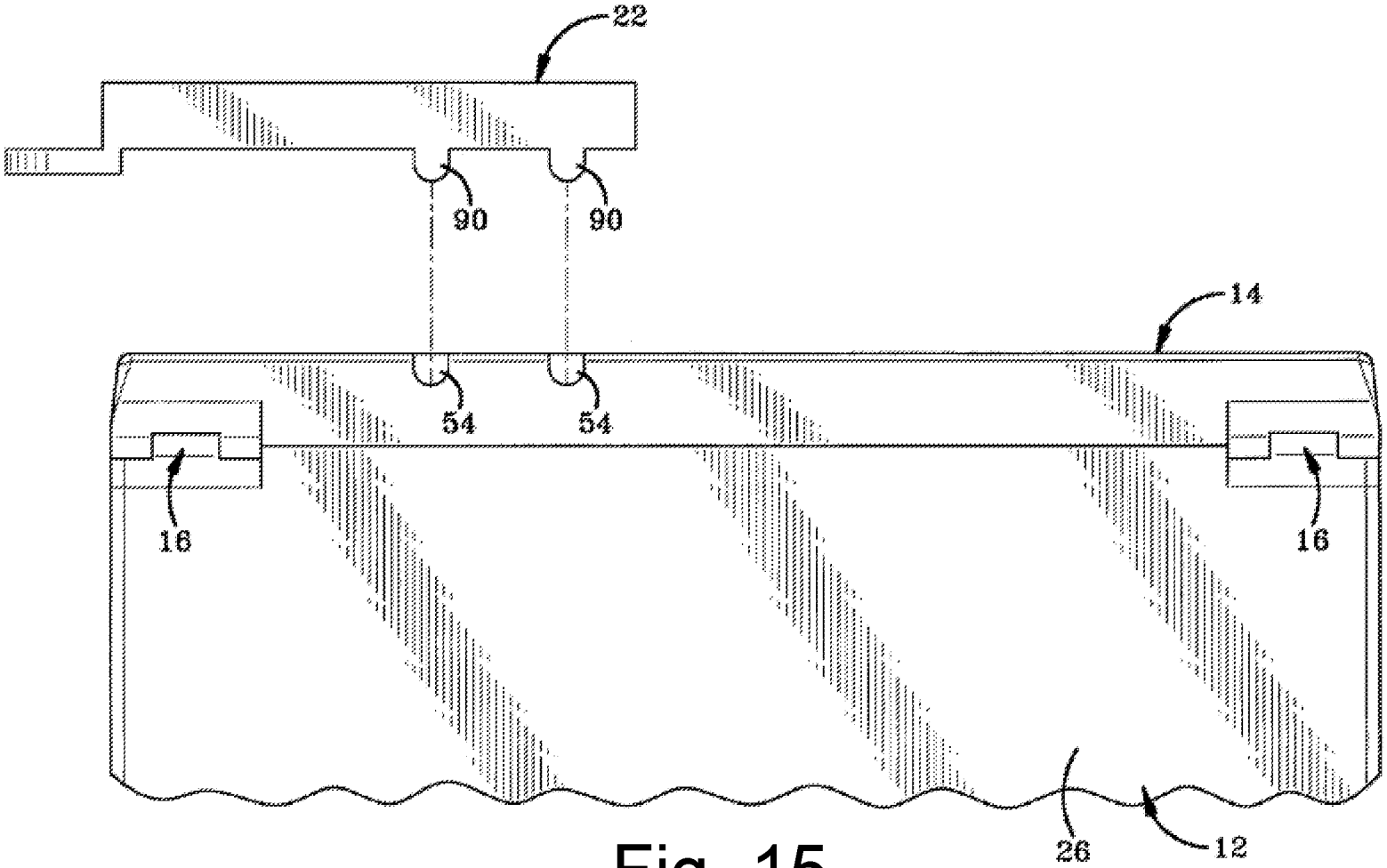
Figure 17A:
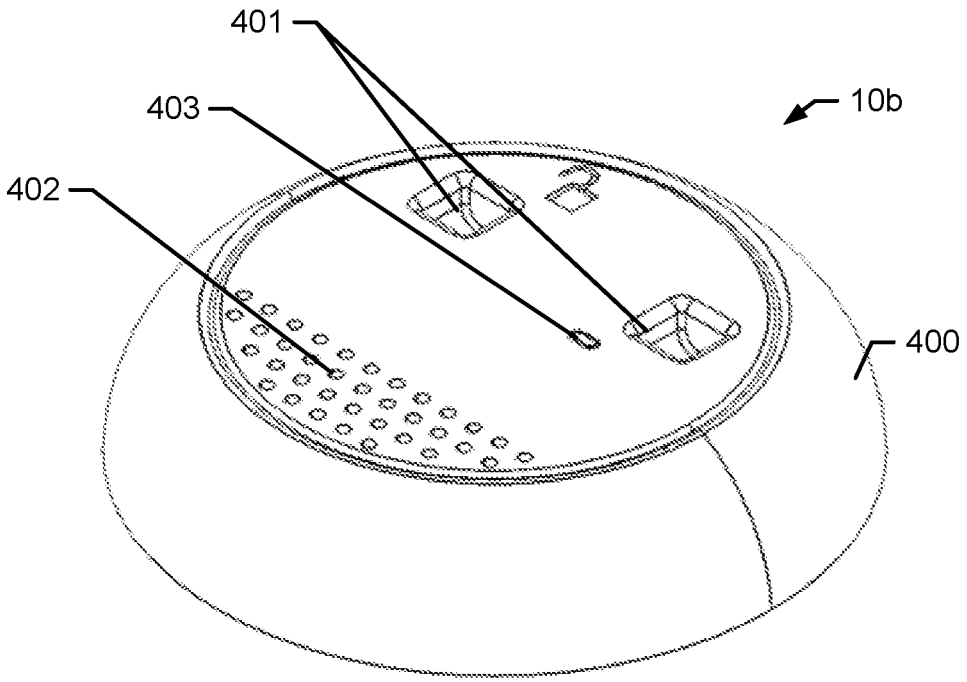
Figure 17B:
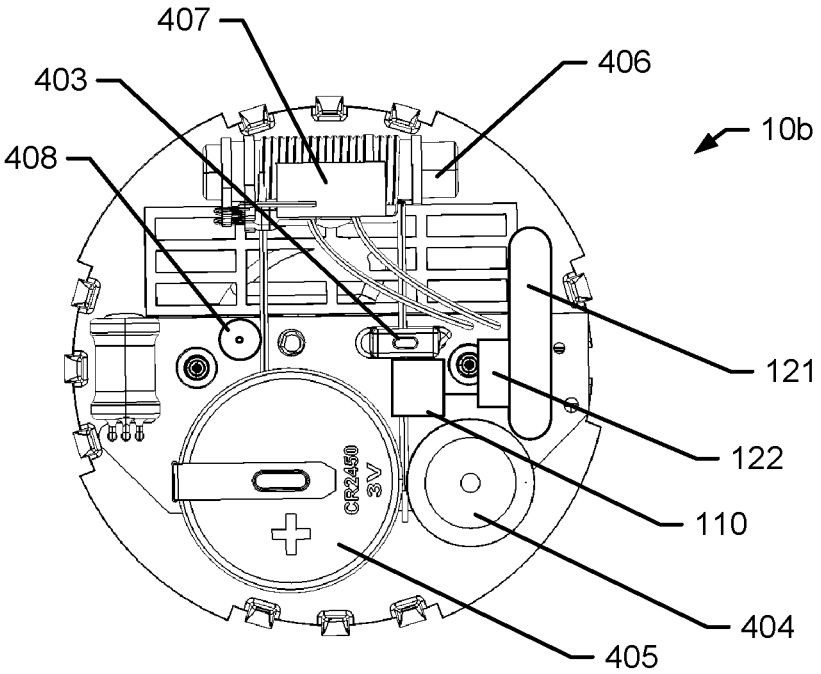
Figure 17C:
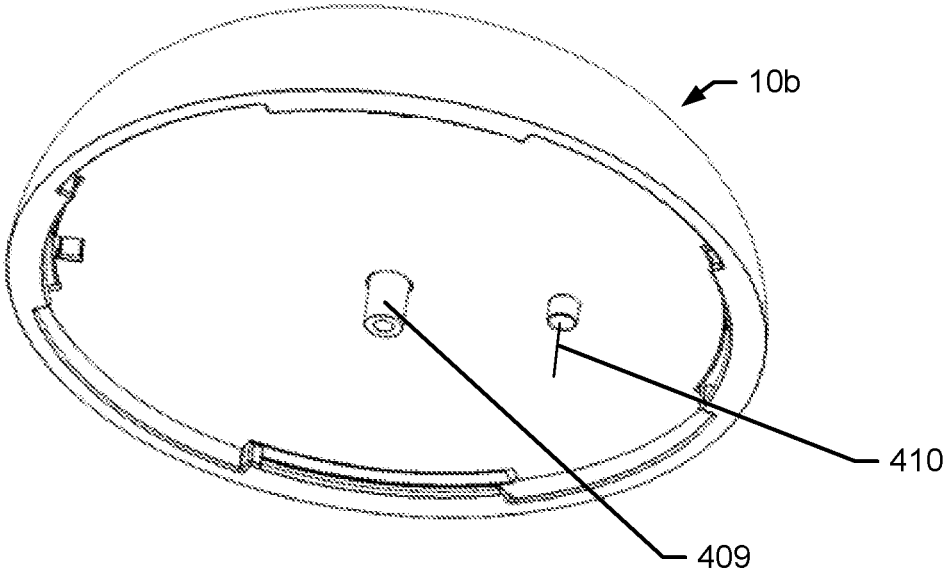
Figure 17D:
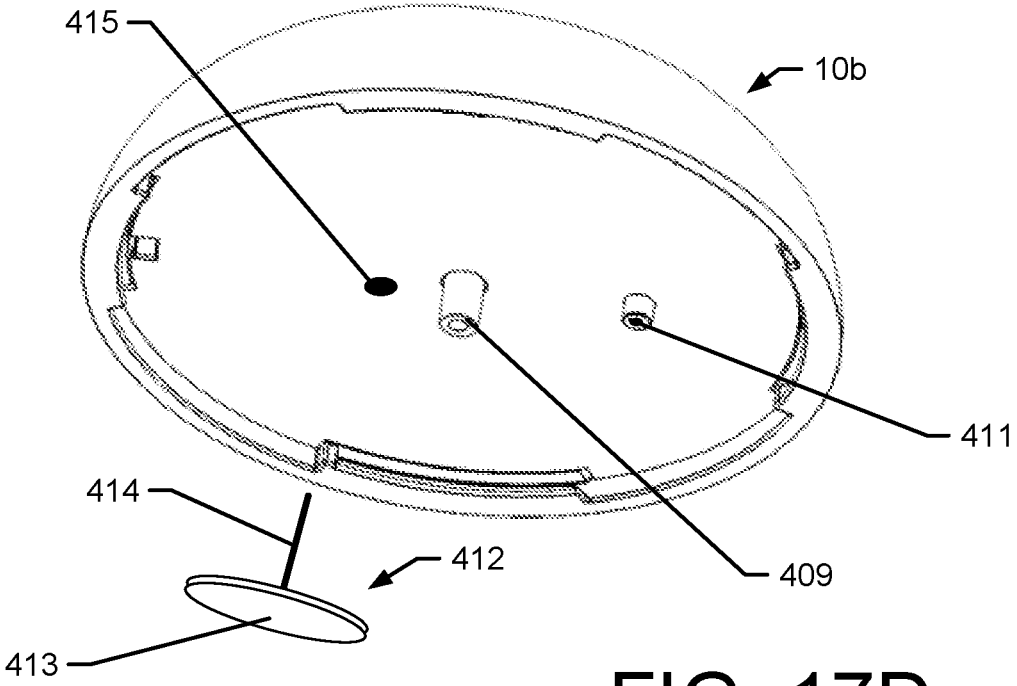
Figure 17E:
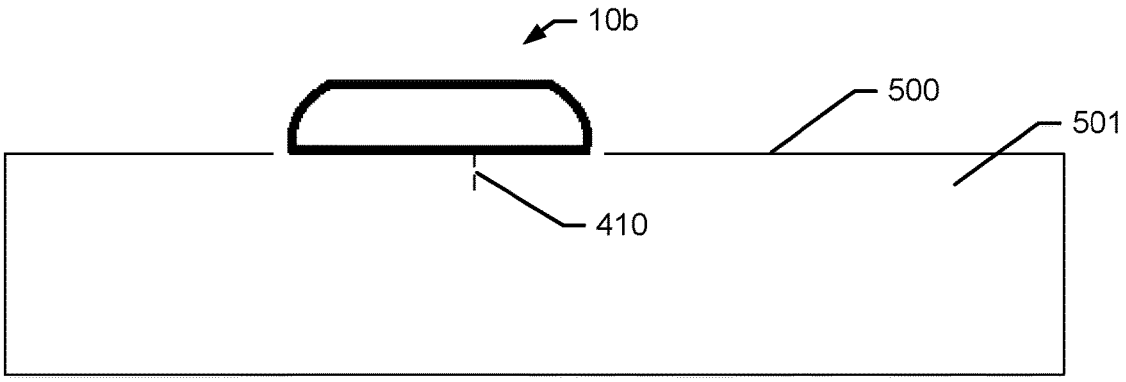
Figure 17F:
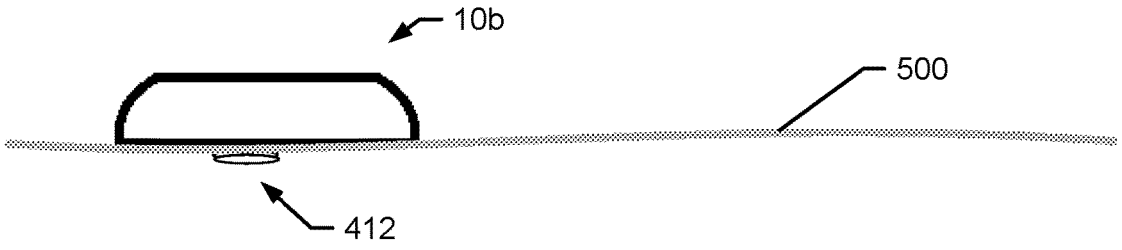
Figure 17G:
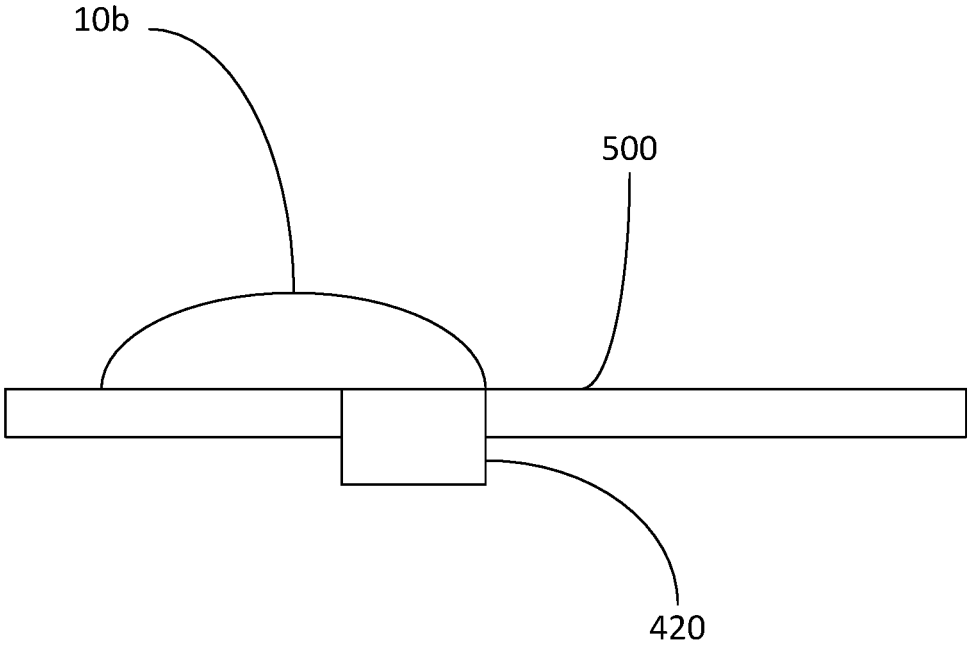
Figure 17H:
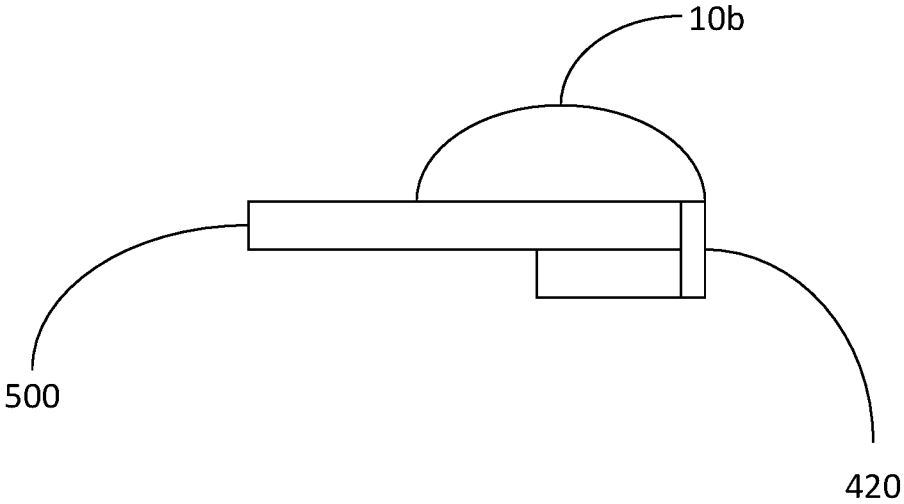
Figure 18:
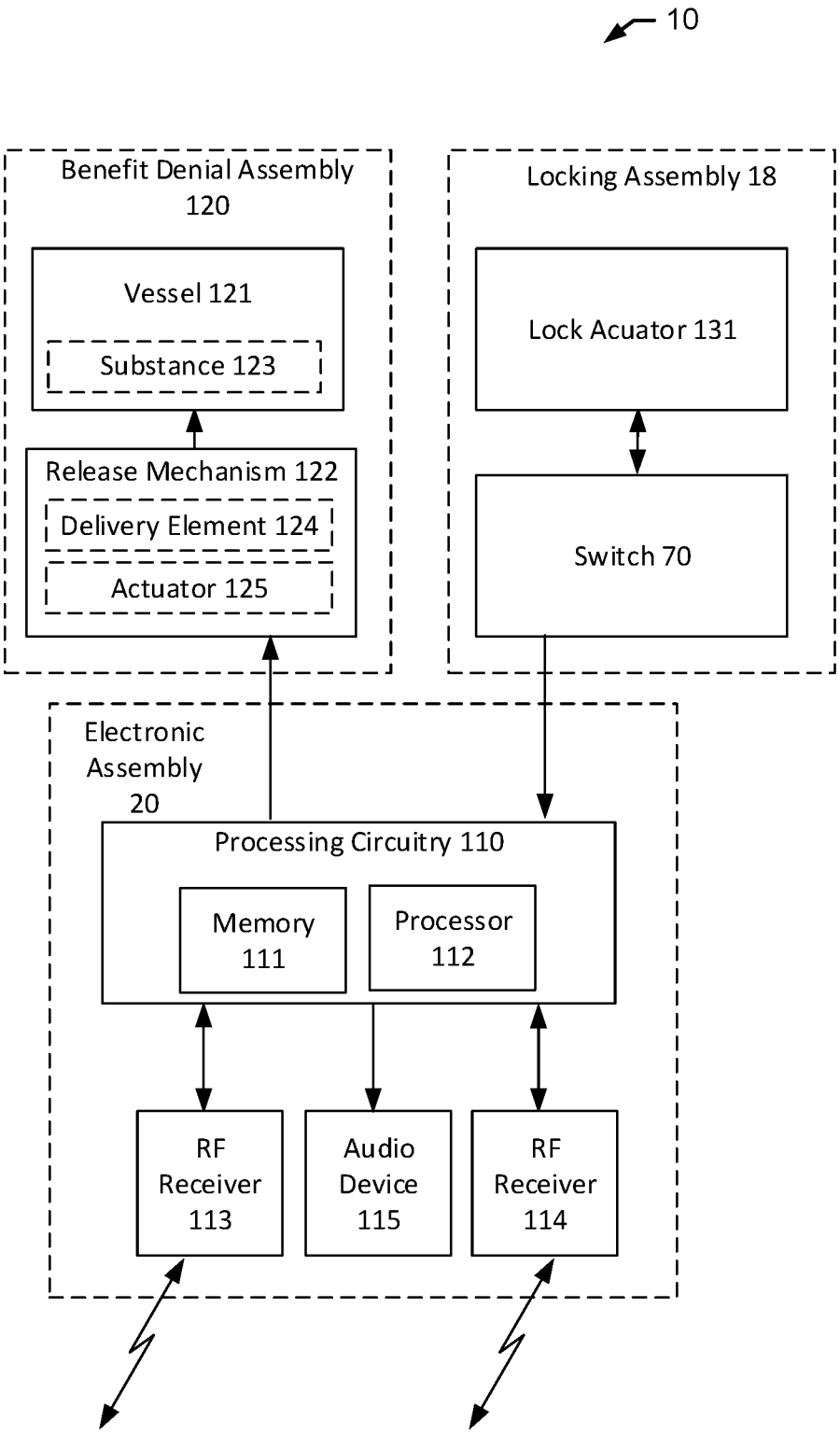
Figure 19A:
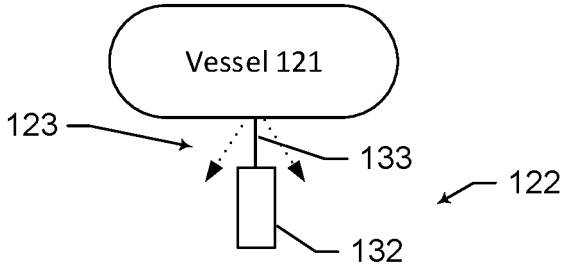
Figure 19B:
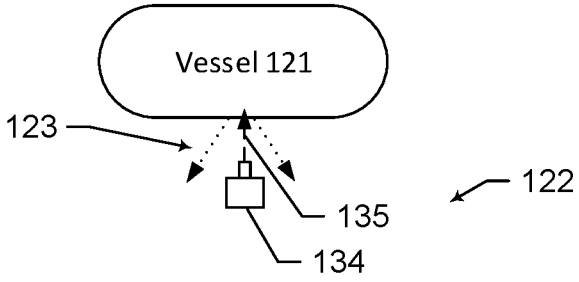
Figure 19C:
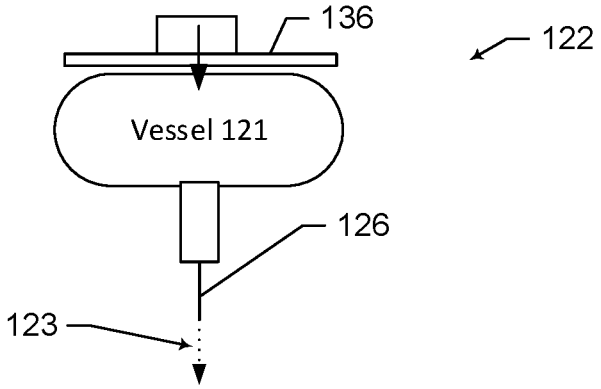
Figure 19D:
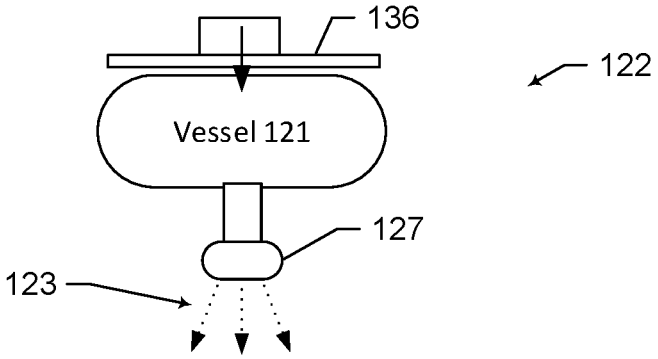
Figure 19E:
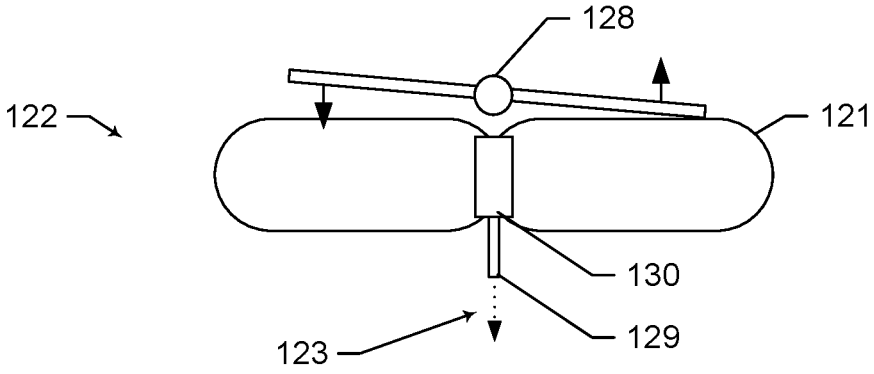
Figure 20:
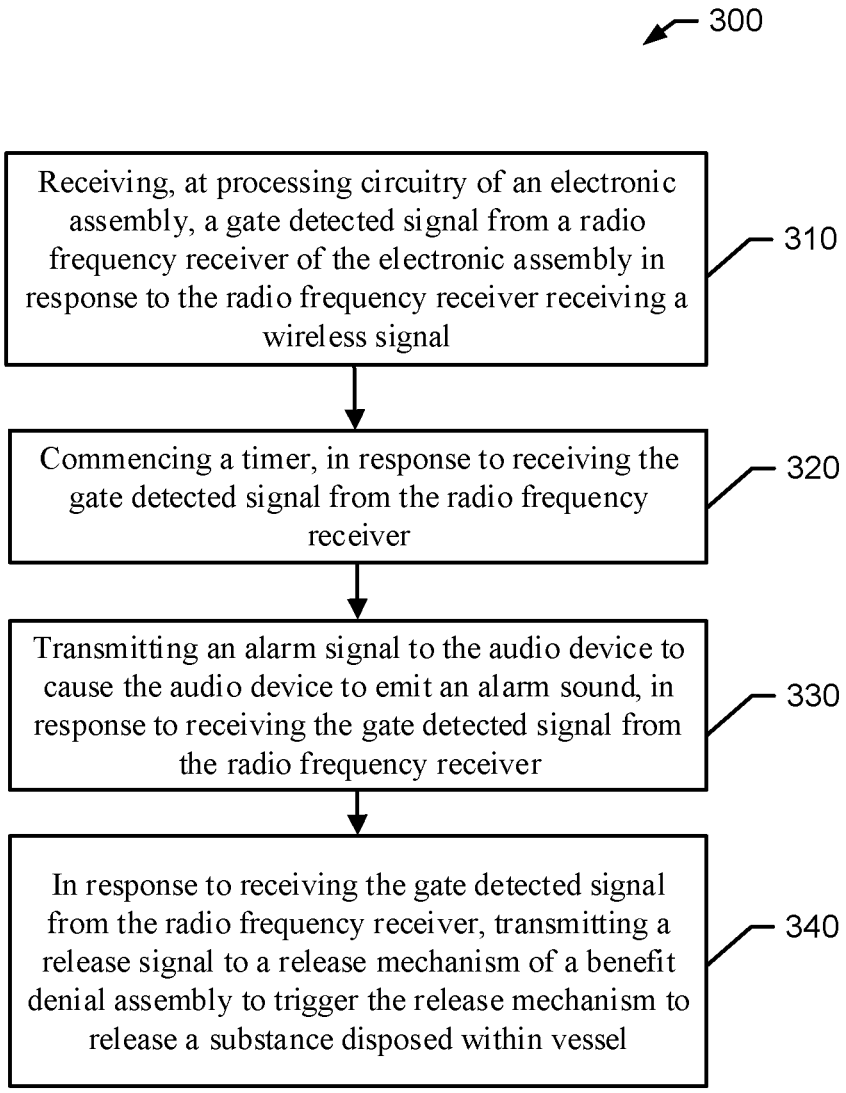

Having thus described the some example embodiments in general terms, reference will now be made to the accompanying drawings, which are not necessarily drawn to scale, and wherein:

FIG. 1 is a front plan view of a security device including a container in accordance with some example embodiments;

FIG. 2 is a top view of a security device in accordance with some example embodiments;

FIG. 3 is a rear plan view of a security device in accordance with some example embodiments;

FIG. 4 is a right side view of a security device in accordance with some example embodiments;

FIG. 5 is a partial front view of an upper end of a security device showing a hinge connection between a base and a lid of the container in accordance with some example embodiments;

FIG. 6 is an exploded front view of a lid of a security device in accordance with some example embodiments;

FIG. 7 is a bottom view of a lid of a security device in accordance with some example embodiments;

FIG. 8 is an exploded view of a lid of a security device in accordance with some example embodiments;

FIG. 9 is an exploded view of a battery holder assembly in accordance with some example embodiments;

FIG. 10 is top view of a battery holder assembly in accordance with some example embodiments;

FIG. 11 is a partial cut-away top view of a lid of a security device in accordance with some example embodiments;

FIG. 12 is a partial cross-sectional front view of a lid and a slider in an unlocked position as taken through line 12-12 of FIG. 11 in accordance with some example embodiments;

FIG. 13 is a partial cut-away top view of a lid in the unlocked position in accordance with some example embodiments;

FIG. 14 is a partial cross-sectional front view of a lid and a slider in a locked position as taken through line 14-14 of FIG. 13 in accordance with some example embodiments;

FIG. 15 is a partial cut-away top view of a lid in a locked position in accordance with some example embodiments;

FIG. 16 is a partial cross-sectional side view of a lid being engaged by a magnetic key to unlock the locking assembly in accordance with some example embodiments;

FIG. 17A is a perspective view of a security device in the form of a tag in accordance with some example embodiments;

FIG. 17B is a view of the internal components of a security device in the form of a tag in accordance with some example embodiments;

FIG. 17C is a perspective bottom view of a security device in the form of a tag having a delivery element in the form of a tube in accordance with some example embodiments;

FIG. 17D is a perspective bottom view of a security device in the form of a tag having a delivery opening in accordance with some example embodiments;

FIG. 17E is a side view of a security device in the form of a tag affixed to an article that includes a box in accordance with some example embodiments;

FIG. 17F is a side view of a security device in the form of a tag affixed to an article that is a garment in accordance with some example embodiments;

FIG. 17G is a side view of a security device in the form of a tag affixed to an article that is a garment in accordance with some example embodiments;

FIG. 17H is a front view of a security device in the form of a tag affixed to an article that is a garment in accordance with some example embodiments;

FIG. 18 is a block diagram of selected components of a security device in accordance with some example embodiments;

FIGS. 19A-19E show various release mechanisms in accordance with some example embodiments; and FIG. 20 is a flow chart of an example method for a substance release benefit denial security device in accordance with some example embodiments.

DETAILED DESCRIPTION OF SOME EXAMPLE EMBODIMENTS

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other.

According some example embodiments, an example security device for deterring retail theft by having functionality to release a substance to interface with the article (e.g., a product with or without product packaging) as a benefit denial technique is provided. According to some example embodiments, the example security device may include a locking assembly that operates to inhibit the ability to physically separate the security device from an article. According to some example embodiments, the example security device may comprise a lockable container within which, an article may be secured. According to other example embodiments, an example security device in the form of a tag may be affixed to an article (e.g., a product or product packing such as a box, blister pack, the material of a garment, etc.). The security device may also include an electronic assembly comprising a radio frequency (RF) receiver, such as, an electronic article surveillance (EAS)

tag. The electronic assembly may also include processing circuitry. Further, the security device may include a benefit denial assembly comprising a vessel filled with a substance, such as for example, an expanding foam. The benefit denial assembly may further include a release mechanism configured to release the substance to interact with the article (e.g., into the container or on to a surface of the article) in response to detection of a theft condition. In this regard, according to some example embodiments, the benefit denial assembly may include a delivery element, such as a port, nozzle, or a tube. An example tube may have, according to some example embodiments, a sharpened tip similar to a hypodermic needle. In an example embodiment including a tube, the tube may pass into an internal cavity of the article, and the substance may be released into the cavity. In example embodiments where the delivery element is a port or nozzle, the substance may be released (e.g., sprayed) onto an external surface of the article.

According to some example embodiments, releasing the substance may include opening an orifice in the vessel (e.g., by piercing, crushing, or bursting the vessel). The release mechanism may be coupled to and triggerable by the processing circuitry. In this regard, the processing circuitry may be configured to trigger the release mechanism in response to receiving an indication that the RF receiver received a wireless signal from, for example, an EAS gate installed at an exit of a retail establishment, which would indicate a possible theft. The triggered release mechanism may release the substance from the vessel to interact with the article. The substance may interact with the article to either damage or adhere to the article to perform a benefit denial function to deter theft and defend against organized retail crime (ORC).

Referring to FIGS. 1-16, an example security device 10*a* may comprise a container 11 formed by a base 12 and a lid 14. Together, the base 12 and the lid 14 may form a six-sided box. The lid 14 may be hingedly connected or affixed to base 12 and movable between open and closed positions. Base 12 may be sized to receive an article such as a retail product with or without product packaging (not shown). Lid 14 may cooperate with base 12 to surround and secure the article when lid 14 is in the closed position. Lid 14 preferably is pivotally mounted to base 12 by way of a hinge 16. Security device 10*a* may also include a locking assembly, generally indicated at 18 (FIG. 8), for securing lid 14 and base 12 together and preventing the unauthorized removal of the article from within base 12. Security device 10*a* may also include an electronic assembly, generally indicated at 20. Electronic assembly 20 may include a light, such as an LED 82, to indicate that security device 10*a* is armed, an EAS tag 84, and an audio device, such as a sound emitting speaker 80. One or more of the components of the electronic assembly 20 may be triggered when, for example, an attempt is made to pry lid 14 off base 12, when the electronic assembly 20 is brought into the proximity of a security gate of a store, or if security device 10*a* is removed from the store without first disarming the electronic assembly 20 with a key 22 (FIG. 16). Security device 10*a* with its integral electronic assembly 20 may be designed to be used as part of a security system for merchandise such as the system disclosed in pending U.S. application Ser. No. 11/312,266, filed Dec. 20, 2005, and entitled "Electronic Security Device and System for Articles of Merchandise", (now abandoned) which application claimed priority from U.S. Provisional Application Ser. No. 60/639,770, filed Dec. 28, 2004. The entire specifications of these two applications are incorporated herein by reference.

Security device 10*a* may be adapted to receive an article, such as retail products, such as computer software boxes, books, jewelry boxes, electronics boxes and the like. Base 12 is typically manufactured from a transparent material that allows the customer to view the article held within security device 10*a*. Base 12 may include a front wall 24, back wall 26, and opposing left and right side walls 28 which extend upwardly and outwardly away from a bottom wall 30. Walls 24, 26, 28 and 30 may be disposed in the form of a five-sided frame or box having an open end disposed opposite bottom wall 30.

Lid 14 may be pivotally connected to base 12 by hinges 16 which may be rotatable about hinge-pins 16*a*. Lid 14 may close the open end of the box when lid 14 is in the closed position and may allow access to the interior cavity of the box when lid 14 is in the open position. Lid 14 may be manufactured from an opaque material so that, for example, an observer cannot determine if an EAS tag is present within lid 14 and also cannot view the various components of the locking assembly for securing security device 10*a* in a closed and locked position. Lid 14 may be locked to base 12 by any suitable locking assembly or mechanism including mechanically-actuated devices and magnetically actuated devices. However, an example of a suitable locking mechanism is the mechanism shown and described in pending U.S. patent application Ser. No. 10/371,570, filed Dec. 21, 2003, now U.S. Pat. No. 7,194,879. The entire specification of application Ser. No. 10/371,570 is incorporated herein by reference.

Lid 14 may be locked to base 12 by a slider 32, which may be slidably secured to an interior surface of lid 14, and by a locking assembly 18 (FIG. 8). Slider 32 may be slidably secured to lid 14 by a plurality of fasteners 33 which may be received through slots 35 in slider 32 and into bosses 37 formed in the interior surface 14*a* of lid 14. Slider 32 may be selectively slidable relative to the interior surface 14*a* of lid 14 and may be moveable between locked and unlocked positions. Locking assembly 18 may comprise a magnetically actuated locking arm 36 that has two spring-biased moveable fingers 46. Arm 16 and fingers 46 may be designed to engage a portion of slider 32 that includes angled pockets 47. Pockets 47 may be sized and shaped to receive fingers 46 therein and to prevent the withdrawal of the same therefrom unless the fingers 46 are acted upon by the magnetic key 22. Locking assembly 18 may hold slider 32 in the locked position when locking assembly 18 is in its locked position, i.e., when fingers 46 are retained within pockets 47. Locking fingers 46 may be moved from the locked position (FIG. 14) to an unlocked position (FIGS. 12 & 16) by using key 22. Key 22 may have magnets 38 disposed so as to align with the fingers 46 on locking arm 36 when key 22 is correctly positioned on lid 14. Magnets 38 attract fingers 46 toward the magnets 38 and, once fingers 46 are realigned with locking arm 36, the user can manipulate the finger tab 44 and slide slider 32 back into the open position. It will be understood that locking assembly 18 may be carried by either lid 14 or slider 32 and may engage pockets 47 formed on the other of lid 14 and slider 32 depending on the particular design of locking mechanism 36.

Slider 32 may include a plurality of spaced L-shaped lock tabs 40 which are shown in FIGS. 6 and 8. Lid 14 may include a plurality of spaced apart tabs 41 which may be seen in FIGS. 7 and 8. Furthermore, the front wall 24 of base 12 may include a plurality of spaced-apart hook tabs 34 which extend upwardly and outwardly therefrom. Each hook tab 34 may include a U-shaped slot that lies substantially parallel to the upper edge of the front wall 24. Tabs 34, 40 and 41 are typically integrally fabricated with base 12, slider 32 and lid 14, respectively. When slider 32 is secured to lid 14, the lower leg of each of the L-shaped lock tabs 40 may abut an outer surface of one of the tabs 41. Hook tabs 34 and lock tabs 40 may engage each other and disengage from each other when slider 32 is slidably moved between the locked and unlocked positions. When slider 32 is moved to lock lid 14 and base 12 together, the lower leg of each lock tab 40 may slide along the upper surface of the associated tab 41 and into the U-shaped slot of the adjacent hook tab 34. This interlocking of lock tabs 34 and 40 substantially prevents lid 14 from being pivoted from a closed position to an open position and security device 10*a* is therefore locked. When slider 32 is moved in the opposite direction, the lower legs of lock tabs 40 slide out of the U-shaped slot of the associated hook tab 34. Lid 14 may then be in an unlocked state where it may be pivoted between a closed and an open position to allow access to the interior cavity in base 12.

Lid 14 is also provided with an aperture 48 which receives a speaker grille 50 and light post 52 of electronic assembly 20; and is furthermore provided with a pair of alignment indicators 54 which are used to correctly position key 22. Speaker grille 50 and light post 52 may be integrally formed with a battery holder assembly 56 (FIG. 6) which is sandwiched between lid 14 and slider 32. Battery holder assembly 56 may be fixedly connected to lid 14 by a plurality of fasteners 58 (FIG. 7) which extend through mounting holes 60 in assembly 56 and into bosses 62 (FIG. 8) which are integrally formed on interior surface 14*a* of lid 14.

Battery holder assembly 56 is provided with the circuitry and other components of electronic assembly 20. In particular, battery holder assembly 56 may include at least a pair of switches 68, 70; a solid state circuit board 72 which substantially controls the electronic assembly; a battery 74 and associated battery cover 76, battery terminals 78; a speaker 80 (FIG. 10) a light-emitting diode (LED) 82 positioned to emit light toward light post 52; and the EAS tag 84. The LED 82 may be designed to flash when electronic assembly 20 is activated. The EAS tag 84 may be radio frequency (RF) sensitive or magnetically sensitive (AM) and is designed to actuate a security gate alarm when it is detected by the security gate. In this regard, the EAS tag 84 may be an example of an RF receiver 113 (FIG. 16). Switch 68 extends outwardly through an opening 88 in battery holder assembly 56 and through a slot 89 (FIG. 6) in slider 32. Switch 70 may extend outwardly from assembly 56 and into engagement with a projection 90 on slider 32. Battery cover 76 may be secured to battery holder assembly 56 by a plurality of fasteners 75 which are inserted through holes 86 in cover 76 and into holes 87 (FIG. 9) in assembly 56. Slider 32 also includes an aperture 64 through which battery cover 76 extends for a short distance. Fasteners 75 may be easily accessed through aperture 64. As may be seen in FIG. 8, aperture 64 may be smaller in length and width than battery holder assembly 56, but may be wider than battery cover 76. The additional width of aperture 64 may be provided so that as slider 32 moves back and forth, battery cover 76 is not engaged by slider 32. While the embodiments are shown as including a coin cell type battery, it will be appreciated that the device and housing can be configured to utilize any shaped battery size as desired for a particular purpose or intended application.

Although not specifically shown in the attached figures, electronic assembly 20 also includes a plurality of sensors connected to circuit board 72. The sensors may monitor the state of the electric circuit in the system and indicate when the circuit is broken. In the event of an interruption in the circuit, a signal is sent by the circuit board 72 to sound the internal audible alarm in the system.

The security device 10*a* may be used in the following manner. When locking assembly 18 is in the unlocked position (FIGS. 11 & 12), lid 14 may be opened to allow for the insertion of an article into base 12. Lid 14 may then be rotated to close the open end of base 12. The user may then push finger tab 44 in the direction of the arrow "A" (FIG. 13), causing the slider 32 to move in the direction of the arrow "A". As previously described, this movement causes lock tabs 40 and hook tabs 34 to engage each other. As shown in FIG. 14, movement of slider 32 may also cause fingers 46 of lock arm 36 to slide into a position over pockets 47. Fingers 46 may be spring-biased into alignment with the planar lock arm 36. Consequently, when fingers 46 are disposed over pockets 47, they spring out of alignment with arm 36 and become engaged in pockets 47 thereby further locking lid 14 and base 12 together. Furthermore, as shown in FIG. 13, movement of slider 32 causes switch 70 to ride along projection 90 thereby causing switch 70 to move into a position where the electric circuit in security device 10*a* is closed. The movement of slider 32 also causes switch 68 to slide in opening 88 and slot 89 into a position where the electric circuit is closed. The closing of the electric circuit may cause LED 82 to begin to emit light, that light being magnified and seen through light post 52 on lid 14. LED 82 may indicate to the consumer that the security device 10*a* is now alarmed. Preferably LED 82 is configured to blink so as to direct the consumer's attention to the fact that security device 10*a* is alarmed. Furthermore, the closure of the circuit results in power being supplied to the EAS tag 84 and to the speaker 80. Consequently, if any attempt is made to pry lid 14 from base 12, the sensors in electronic assembly 20 will be triggered and the speaker 80 will emit a loud, attention-getting sound. The security device 10*a* can be preprogrammed to emit a sound for a predetermined length of time, such as 10 minutes for example. Furthermore, even if no attempt is made to pry lid 14 from base 12, if security device 10*a* is brought within a certain preprogrammed range of a security gate at an entrance or exit of the protected environment, the EAS tag 84 will be triggered and thereby cause the security gates to sound a remote alarm. Simultaneously, the speaker 80 in security device 10*a* will also begin to emit a loud, attention-getting sound. The alarm may only be switched off by engaging security device 10*a* with specially designed key 22.

In order to prevent the electronic assembly from being triggered to sound an alarm after the merchandise has been legally purchased by the customer, security device 10*a* can be disarmed by aligning key 22 with locking assembly 18. Key 22 may be correctly aligned on security device 10*a* by protrusions 90 (FIG. 15) on key 22 into apertures 54 on lid 14. This brings magnets 38 (FIG. 16) into the proximity of fingers 46 on locking assembly 18. Fingers 46 are attracted toward magnets 38 and are thereby withdrawn from pockets 47 in base 32. The finger tab 44 may then be moved in the opposite direction to the arrow "A", thereby moving slider 32 in the opposite direction to the arrow "A" relative to lid 14. As slider 32 moves in this second direction, switch 70 slides along projection 90 from the position shown in FIG. 13 to the position shown in FIG. 11. Furthermore, switch 68 slides in the opposite direction through opening 88 and slot 89. The movement of switches 68 and 70 may break the electric circuit in security device 10*a*, thereby disarming the electronic assembly 20. The movement of slider 32 in the opposite direction to the arrow "A" may also cause lid 14 to be unlocked. Lid 14 can then be rotated into the open position and the article may be removed from within base 12.

With reference to FIGS. 17A-17F another example security device 10*b* is provided. In this regard, security device 10*b* may be in the form of a tag that may be affixed to the exterior of an article (e.g., product packaging, such as a box, or a garment). The security device 10*b* may be affixed to an article in a number of alternative ways such as, via a mounting plate, direct adhesive, or via a locking pin. The security device 10*b* may also include the functionality to release a substance as described herein to interact with an article to perform a benefit denial functionality.

With reference to FIG. 17A, a top perspective view of an example security device 10*b* is shown. In this regard, the security device 10*b* may include a housing 400, possibly formed of plastic. The housing 400 may include key locators 401 to assist in positioning the key 22 on the housing 400 to transition the security device 10*b* from a locked configuration to an unlocked configuration. Further, the security device 10*b* may include an armed indicator light 403 and a sound grill 402 that facilitates emission of an alarm sound by an internal sounder.

FIG. 17B shows an overhead view of some internal components of the security device 10*b* with the housing 400 removed. In this regard, the security device 10 may include an electronic assembly, a benefit denial assembly, and a locking assembly. The electronic assembly may be one example of the electronic assembly 20 and may include processing circuitry 110 that functions as further described below. The electronic assembly may include a light, such as an LED 403, to indicate that security device 10*b* is armed, an EAS tag 406 (e.g., similar to or the same as EAS tag 84), and an audio device, such as a sound emitting speaker 404. The processing circuitry 110 may be configured to control the operation of the benefit denial assembly 120 and receive indications from the locking assembly.

The benefit denial assembly may include a vessel 121 and a release mechanism 122 as further described herein. The locking assembly may include a key detection switch 407, and an article engagement switch 409 (see FIGS. 17C and 17D). The locking assembly may further include, according to some example embodiments, a pin lock 408, for example, in the form of a ball clutch. The key detection switch 407 may be configured to detect the presence of a key 22, which may be a magnetic key, interfacing with the security device 10*b*. When the key detection switch 407 detects the key 22, the processing circuitry 110 may be informed by the detected state of the switch 407 in the form of a disarm signal, and the security device 10*b* may be permitted to transition from a locked state to an unlocked state without sounding an alarm via the speaker 404. The key detection switch 407 may include ferrous material that moves to actuate the key detection switch 407, when the key detection switch 407 is in the presence of a magnet, such as a magnet of the key 22. In this regard, the security device 10*b* may be in the locked state when article engagement switch 409 is actuated (e.g., depressed), as detected by processing circuitry 110, to indicate that the security device 10*b* has been affixed to an article to protect. Accordingly, the locking assembly may include the article engagement switch 409 that is configured to actuate into an unlocked (e.g., extended) position in association with application of the key 22 to generate a disarm signal in response to the locking assembly transitioning into the unlocked state. Further, article engagement switch 409 may be configured to send or generate an alarm signal to be received by the processing circuitry 110 in response to the actuation of the article engagement switch 409 when the key 22 is not applied, and not detected by the key detection switch 407.

With reference to FIG. 17C, it can be seen that article engagement switch 409 may be a plunger switch located on a base of the security device 10*b*. In this regard, when the security device 10*b* is affixed to an article the article engagement switch 409 may be depressed indicating that the security device 10*b* is in a locked and armed configuration. The security device 10*b* may be affixed to a product either via an engagement plate that is adhered to the article or by adhering the security device 10*b* directly to the article. In situations where the article includes a box or other packaging having a cavity within, the tube 410, which may be retractable, pierce the packaging with a sharp tip to permit the tube 410 to enter the cavity. This configuration is shown in FIG. 17E wherein the tube 410 is disposed in the cavity 501 of the article 500. A release mechanism comprising a tube is further described herein, particularly with respect to functionality. Further, if the article engagement switch 409 is actuated in the absence of a detection of the key 22 by the key detection switch, the processing circuitry 110 may be configured to cause an alarm to sound via the speaker 404.

Alternatively, the security device 10*b* may be affixed to an article having fabric or the like via a lockable pin. In this regard, with reference to FIG. 17D, a pin 412 may be locked to the security device 10*b* via the pin lock 408. The pin 412 may include a pin head 413 that is broad enough to engage the article engagement switch 409 when the pin 412 is locked into the pin lock via the opening 415 in the base of the security device 10*b*. In this regard, with reference to FIG. 17F, it can be seen that the pin 412 may be used to pierce the fabric of article 500 and lock into the security device 10*b* while engaging the article engagement switch 109. Additionally, it can be seen in FIG. 17D that the security device 10*b* may include an opening 411 through which a substance 123 may be released as part of a benefit denial functionality of the security device 10*b*. It will be appreciated that where a pin lock assembly is used, the system may include multiple pin locks and pins if desired.

Another suitable manner to affix the tag to an article is by using a clamp to apply a clamping force to hold the device onto the article. Referring to FIGS. 17G and 17H, the tag 10*b* may have a body of any shape as desired including, for example, those described in FIG. 17A-E except that the body includes a clamping mechanism 420 to extend on opposing face of the article 500 to lock or secure the tag to the article. The shape or size of the clamping mechanism is not limited to any shape, size, or design, and may be chosen as desired for a particular purpose or intended application.

With reference now to FIG. 18, a block diagram of selected components of a security device 10 (e.g., 10*a* or 10*b*) are shown. In this regard, an electronic assembly 20 is shown with processing circuitry 110. Processing circuitry 110 may include a processor 112 and a memory 111. The processor 112 may be any type of microprocessor, field programmable gate array (FPGA), or application specific integrated circuit (ASIC). The processor 112 may be configured either in hardware or through the execution of software instructions (e.g., stored in the memory 111) to embody and implement functionalities to support the operation of the security device 10. The processor 112 may include input/output pins or connections that permit the processor 110 and the processing circuitry 110 to interface with, receive information from, and control the operation of, peripheral components. The memory 111 may be separate from or integrated with the processor 112.

In this regard, the processing circuitry 110 may be directly or indirectly connected to an RF receiver 113. The RF receiver 113 may be an EAS tag, such as EAS tag 84 or EAS tag 406. In this regard, the RF receiver 113 may be configured to receive a wireless signal emitted by a EAS security gate at an ingress or egress to a retail establishment. The RF receiver 113 may receive the signal from the EAS security gate when the security device 10 is in relatively close proximity to the EAS security gate, and therefore an ingress or egress to the retail establishment. The RF receiver 113 may be configured to operate at frequencies that are common for EAS security gates, such as, for example, about 8.2 MHz or about 58 kHz. The RF receiver 113 may comprise and inductor and a capacitor that form an LC tank circuit that resonates to transmit a return signal to the EAS security gate, in response to a wireless signal generated by the EAS security gate, to trigger an alarm at the EAS security gate.

The RF receiver 113 may also be directly or indirectly connected to the processing circuitry 110. In this regard, the processing circuitry 110 may be configured to monitor the RF receiver 113 to determine whether the RF receiver 113 has received a wireless signal from an EAS security gate. In response to receiving a wireless signal from an EAS security gate, the RF receiver 113 may be configured to provide a gate detected signal to the processing circuitry 110 for receipt by the processing circuitry 110. Receipt of the gate detected signal at the processing circuitry 110 may operate to initiate a number of functionalities of the security device 10 as further described herein.

For example, the receipt of the gate detected signal may cause the processing circuitry 110 to trigger functionalities associated with the benefit denial assembly 120. The benefit denial assembly 120 may be disposed within the security device 10. The benefit denial assembly 120 may comprise a release mechanism 122 and a vessel 121.

The vessel 121 may be a containment device, such as a capsule, sealed tube, packet, canister, or the like for encasing the substance 123. The vessel 121 may be formed of plastic (e.g., thin plastic film), metal (e.g., aluminum) or the like. According to some example embodiments, the substance 123 may be an expanding foam substance (e.g., polyurethane foam). According to some example embodiments, the substance 123 may be a powder, liquid, or a gel (e.g., bleach, dye, or the like) that may mark, damage, deface, or adhere to an article. According to some example embodiments, the substance 123 may be one that changes state from, for example, a liquid or gel to a solid when released and exposed to air, the environment, or a change in pressure or temperature. Further, according to some example embodiments, vessel 121 may be comprised of two compartments that, when triggered, remove a barrier between the compartments to allow sub-component substances in each compartment to mix to form the substance 123 upon mixing of the sub-component substances. According to some example embodiments, the vessel 121 may be pressurized and therefor the substance 123 may be under pressure until an orifice is opened in the vessel 121 by the release mechanism 121.

The release mechanism 122 may be an apparatus that is controlled by the processing circuitry 110 to release the substance 123 from the vessel 121, for example, into the container 11 of the security device 10*a*, and/or into or onto an article. In this regard, for example, the release mechanism 122 may be configured to release the substance 123 by opening an orifice in the vessel 121 to release the substance 123 to engage, damage, or, with respect to security device 10*a*, prevent removal of the article in container 11, thereby performing a benefit denial function in the event that the article and the security device 10 are attempted to be stolen.

The release mechanism 122 may include a delivery element 124 and an actuator 125. The actuator 125 may be controlled by the processing circuitry 110 and may be configured to receive a release signal from the processing circuitry 110 and, in response to the release signal, perform a release action, for example, involving a mechanical actuation. Some examples of actuators 125 that may be employed by the release mechanism 122 may include pumps, pistons, movable piercing elements (e.g., a biased pin), mixers, or the like. The release action performed by the actuator 125 may cause the release of the substance 123 by opening an orifice in the vessel 121 to release the substance 123 via the delivery element 124. According to some example embodiments, the delivery element 124 may be for example, an opened orifice or port in the vessel 121 (e.g., due to the vessel 121 being pierced or burst). A port may be a weakened area of a wall of the vessel 121 to provide a predictable failure point in the wall of the vessel 121. According to some example embodiments, the delivery element 124 may be a tube (e.g., with a sharpened tip) or a nozzle affixed to the vessel 121 to spray the substance 123.

FIGS. 19A-19E show some examples benefit denial assemblies 120 comprising vessels 121 and release mechanisms 122 according to some example embodiments. According to various example embodiments, the release mechanism 122 may be configured to operate in a number of different ways to release the substance 123, for example, into the container 11 or the article, or onto the article in response to receiving a release signal from the processing circuitry 110. The release mechanism 122, and more specifically the actuator 125, may be configured to receive a release signal from the processing circuitry 110 and, in response, perform an release action (e.g., a mechanical actuation) to open an orifice in the vessel 121.

Referring to FIG. 19A, the release mechanism 122 may include a pin 133 and a mechanical actuator 132. Mechanical actuator 132 may be any type of device capable of receiving the release signal and responsively moving the pin 133 towards the vessel 121 to pierce the vessel 121 and form an orifice in the vessel 121. The mechanical actuator 132 may move the pin 133 by employing, for example, a solenoid, a piston, a motor, or the like. Upon forming the orifice in the vessel 121, the substance 123 may be released, for example, into the container 11, into a cavity in an article, or onto an external surface of an article. As such, the formed orifice in the vessel 121 may be the delivery element 124.

Referring to FIG. 19B, the release mechanism 122 may include a pump 134 with a reactant 135 (e.g., acid, water, other solution, or the like) stored therein. The pump 134 may be an actuator that sprays a reactant 135 onto the surface of the vessel 121 to from an orifice in a wall of the vessel 121 by reacting with the material of the wall to weaken the wall and form the orifice. In this regard, the pump 134 may receive the release signal and responsively spray the reactant 135 of the external wall of the vessel 121 to form the orifice and release the substance 123, for example, into the container 11, into a cavity in an article, or onto an external surface of an article. As such, the formed orifice in the vessel 121 may be the delivery element 124.

Referring to FIG. 19C, another example release mechanism 122 is provided. In this regard, the actuator of the release mechanism 122 may be a piston 136. The piston 136 may be an actuator that operates to apply a surface pressure on the vessel 121 to force the substance 123 out of the vessel 121, in response to receipt of the release signal. The substance 123 may be forced out via a variety of delivery elements. According to some example embodiments, a port, as described above, may offer a weakened area that fails upon the piston 136 applying sufficient pressure to the vessel 121. As seen in FIG. 19C, the release mechanism 122 may include delivery mechanism that is a tube 126 through which the substance may be released. According to some example embodiments, the tube 126 may be disposed into a cavity of an article to fill the cavity with the substance 123. In this regard, the article may include a cavity (e.g., an internal cavity of a box or carton), and the tube 126 may be disposed into the cavity of the article when the security device 10 was applied. The tube 126 may be rigid and may have a sharpened tip to facilitate puncturing an external wall of the article cavity resulting in the tube 126 being disposed within the cavity. According to some example embodiments, the tube 126 with a sharpened tip may puncture the wall of the article due to a force provided by the individual installing the security device 10 on the article. According to some example embodiments, the tube 126 with the sharpened tip may puncture the article in response to the release signal by moving towards the article via an actuator (e.g., a solenoid, motor, or other mechanical actuator that operates to move the tube 126 or remove a stop to permit movement of tube 126 due to, for example, a bias placed on the tube 126 by, for example, a spring.

Alternatively, according to some example embodiments, as shown in FIG. 19D, the delivery element may be a nozzle 127 affixed to the vessel 121. In this regard, the piston 136 may apply a pressure on the vessel 121 to force the substance 123 out of the nozzle 127 to release the substance 123 onto or within an article. The nozzle 127 may operate to spread the substance in larger area to interact with larger portion of the surface of the article.

Referring to FIG. 19E, another example release mechanism 122 is provided. The vessel 121 may have two compartments with sub-component substances in each. Upon receipt of the release signal a barrier 130 between the compartments may be opened to permit the sub-component substances to mix to form the substance 123. According to some example embodiments, a mixer 128 may repeatedly actuate (e.g., rotate to apply repeated periodic pressure on each of the compartments) to open the barrier and/or apply repeated changes in pressure on the compartments to facilitate mixing of the sub-component substances in the compartments. The resultant substance 123 may be released via a delivery element 129, such as those described in FIGS. 19A-19D.

As described above, according to some example embodiments the release action may be, for example, to control a solenoid, motor, pump or the like. Further, according to some example embodiments, the vessel 121 may include a plug and the release mechanism 122 may be configured to actuate a motor, solenoid, or the like to remove the plug from the vessel 121 to open the orifice in the vessel 121. According to some example embodiments, the substance 123 may, for example, be pumped, using a pump device that is part of the release mechanism 122 and controlled by the processing circuitry 110 using the release signal. In this regard, the processing circuitry 110 may control a component, such as a piezo, to cause a vibration that creates a pump action to agitate and release the substance from the vessel 121.

According to some example embodiments, a timer delay may be employed by the processing circuitry 110 prior to transmitting the release signal to the release mechanism 122. In this regard, the processing circuitry 110 may be further configured to, in response to receiving the gate detected signal from the radio frequency receiver, commence a timer. Accordingly, the processing circuitry 110 may be further configured to transmit the release signal to the release mechanism 122 in response to receiving the gate detected signal from the RF receiver 113 and the timer reaching a threshold value. In this regard, the timer may not be commenced until the processing circuitry 110 receives the gate detected signal and the timer may then count down or up to a threshold value (e.g., zero if counting down). Upon reaching the threshold value, the processing circuitry 110 may proceed to transmit the release signal to the release mechanism 122. According to some example embodiments, the time may reach the threshold value in, for example, one minute, five minutes, or the like. Additionally, according to some example embodiments, the processing circuitry 110 may be configured to direct the audio device to emit a sound (e.g., a repeated short tone) while the timer is running.

By employing a timer as described above, the security device 10 may offer the opportunity to interrupt the benefit denial process, if, for example, store personnel accidentally did not remove the article from the security device 10*a* or remove the security device 10*b* from the article after the article had been properly purchased. In this regard, the processing circuitry 110 may be configured to detect an action taken by store personnel in response to such a situation and stop or cancel the timer to avoid release of the substance 123. The processing circuitry 110 may therefore be configured to receive a disarm signal and, in response to receiving the disarm signal, stop the timer (i.e., prevent the timer from reaching the threshold value).

The disarm signal may be initiated in a number of ways, according to various example embodiments. For example, the disarm signal may be provided via the switch 70 (e.g., key detection switch 407) of the locking assembly 18. In this regard, when the locking assembly 18 is transitioned to the unlocked state (e.g., as described above), a lock actuator 131 (e.g., the slider 32 or the like) may cause the state of the switch 70 to change, thereby providing the disarm signal to the processing circuitry 110. Since, according to some example embodiments, the key 22 is required to transition the locking assembly 18 to the unlocked position, and the key 22 should only be in the possession of the store personnel, the disarm signal, in this regard, may be provided only when store personnel have taken action to disarm the security device 10 to prevent the release of the expanding foam substance 123 into the container.

Alternatively, the disarm signal may be provided to the processing circuitry 110 by the RF receiver 113 or another RF receiver 114. In this regard, for example, the RF receiver 113 may receive a wireless disarm signal (i.e., different from the standard wireless gate signal emitted by an EAS gate, such as, for example, a higher power signal of a deactivator), and provide a disarm signal to the processing circuitry 110. Similarly, the electronic assembly 20 may include a second RF receiver 114, which may include an RF antenna that operates at frequency different than an EAS gate. According to some example embodiments, the RF receiver 114 may be a coil associated with a transformer used to excite the audio device 115 that is monitored by the processing circuitry 110. In this regard, according to some example embodiments, the key 22 may include an RF transmitter configured to transmit a wireless disarm signal to the security device 10. The wireless disarm signal transmitted by the key 22 may be received by the RF receiver 114, and the RF receiver 114 may responsively provide the disarm signal to the processing circuitry 110 to stop the timer.

FIG. 20 shows a flow chart of an example method 300 for a substance release benefit denial security device, such as, security device 10 (e.g., security device 10*a* or 10*b*) described above. The example method 300 may include at 310, receiving, at processing circuitry of an electronic assembly, a gate detected signal from a radio frequency receiver of an electronic assembly. The gate detected signal may be provided to the processing circuitry in response to the radio frequency receiver receiving a wireless signal. Further, at 320, the example method 300 may include commencing a timer. The timer may be commenced in response to receiving the gate detected signal from the radio frequency receiver. At 330, the example method 300 may include transmitting an alarm signal to the audio device to cause the audio device to emit an alarm sound, in response to receiving the gate detected signal from the radio frequency receiver. Additionally, the example method 300 may include, at 340, in response to receiving the gate detected signal from the radio frequency receiver and, according to some example embodiments, in response to the timer reaching a threshold value, transmitting a release signal to a release mechanism of a benefit denial assembly. By transmitting the release signal, the release mechanism may be triggered to release a substance disposed within the vessel into or onto an article.

Many modifications and other embodiments set forth herein will come to mind to one skilled in the art to which these inventions pertain having the benefit of the teachings presented in the foregoing descriptions and the associated drawings. Therefore, it is to be understood that embodiments are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A security device comprising:

a locking assembly configured to lock the security device to inhibit separation of the security device from an article and configured to unlock the security device from the article to permit the article to be separated from the security device without sounding an alarm;

an electronic assembly comprising:

a radio frequency receiver; and processing circuitry, the processing circuitry being coupled to the radio frequency receiver;

a benefit denial assembly comprising:

a vessel, wherein a substance is disposed within the vessel;

a release mechanism configured to release the substance into or onto the article, the release mechanism being coupled to and triggerable by the processing circuitry;

wherein the processing circuitry is configured to:

receive a gate detected signal from the radio frequency receiver in response to the radio frequency receiver receiving a wireless signal; and in response to receiving the gate detected signal from the radio frequency receiver, transmit a release signal to the release mechanism to trigger the release mechanism to release the substance.

2. The security device of claim 1, wherein the electronic assembly further comprises an audio device, and wherein the processing circuitry is configured to, in response to receiving the gate detected signal from the radio frequency receiver, transmit an alarm signal to the audio device to cause the audio device to emit an alarm sound.

3. The security device of claim 1, wherein the substance is a liquid, a gel, a powder, or an expanding foam.

4. The security device of claim 1, wherein the processing circuitry is further configured to, in response to receiving the gate detected signal from the radio frequency receiver, commence a timer; and wherein the processing circuitry is configured to transmit the release signal to the release mechanism in response to receiving the gate detected signal from the radio frequency receiver and the timer reaching a threshold value.

5. The security device of claim 4, wherein the processing circuitry is further configured to receive a disarm signal, and in response to receiving the disarm signal, stop the timer.

6. The security device of claim 5, wherein the locking assembly includes a switch configured to actuate into an unlocked position in association with application of a key to generate a disarm signal in response to the locking assembly transitioning into an unlocked state.

7. The security device of claim 6, wherein the switch of the locking mechanism is configured to send an alarm signal in response to actuation of the switch that is not in association with application of the key.

8. The security device of claim 5, wherein the electronic assembly comprises a second radio frequency receiver, and wherein the disarm signal is provided by the second radio frequency receiver in response to receiving a wireless disarm signal.

9. The security device of claim 5, wherein the electronic assembly further comprises an audio device; and wherein the processing circuitry is configured to:

in response to receiving the gate detected signal from the radio frequency receiver, transmit an alarm signal to the audio device to cause the audio device to emit an alarm sound; and in response to receiving the disarm signal, transmit a stop alarm signal to the audio device to cause the audio device to discontinue emitting the alarm sound.

10. The security device of claim 9, wherein the radio frequency receiver comprises an inductor and a capacitor coupled to form a resonant circuit.

11. The security device of claim 10, wherein the resonant circuit is configured to resonate at about 58 kHz or about 8.2 MHz.

12. A security device comprising:

an electronic assembly comprising:

a radio frequency receiver; and processing circuitry, the processing circuitry being coupled to the radio frequency receiver;

a benefit denial assembly comprising:

a vessel, wherein a substance is disposed within the vessel;

a release mechanism configured to release the substance into or onto the article, the release mechanism being coupled to and triggerable by the processing circuitry;

wherein the processing circuitry is configured to:

receive a gate detected signal from the radio frequency receiver in response to the radio frequency receiver receiving a wireless signal; and in response to receiving the gate detected signal from the radio frequency receiver, transmit a release signal to the release mechanism to trigger the release mechanism to release the substance; and wherein the electronic assembly is disposed within a housing, the security device comprising a locking assembly configured to lock the security device to inhibit separation of the security device from an article and configured to unlock the security device from the article to permit the article to be separated from the security device without sounding an alarm, the locking assembly comprising (i) a pin lock disposed within the housing and a pin that is releasably engagable with the pin lock; or (ii) a clamp suitable to apply a clamping force to hold the housing against a surface of an article.

13. The security device of claim 12 comprising an opening in the housing, the opening in communication with the vessel and through which the substance be released.

14. The security device of claim 12, wherein the release mechanism comprises a pin and a mechanical actuator, wherein upon receiving a release signal, the mechanical actuator moves the pin to pierce the vessel and form an orifice in the vessel allowing the substance to be released from the vessel.

15. The security device of claim 12, wherein the release mechanism comprises a pump comprising a reactant, wherein upon receiving a release signal, the pump sprays the reactant onto the vessel to form an orifice in the vessel allowing the substance to be released from the vessel.

16. The security device of claim 12, wherein the release mechanism comprises an actuator that, upon receiving a release signal, is actuated to apply a pressure on the surface of the vessel thereby forcing the substance out of the vessel.

17. The security device of claim 16, wherein the actuator is a piston.

18. The security device of claim 16 wherein the release mechanism comprises a tube in fluid communication with the vessel and the substance flows from the vessel through the tube.

19. The security device of claim 16, wherein the release mechanism comprises a nozzle affixed to the vessel, wherein upon the actuator being actuated to apply a pressure to the vessel, the substance is forced out of the vessel and out of the nozzle.

20. The security device of claim 12, wherein the vessel comprises two or more compartments and a barrier disposed between each of the two or compartments, each compartment comprising a sub-component substance, wherein upon receipt of a release signal, the barriers between the two or compartments is opened to permit mixing of the sub-component sub stances.

21. The security device of claim 12, wherein the electronic assembly further comprises an audio device, and wherein the processing circuitry is configured to, in response to receiving the gate detected signal from the radio frequency receiver, transmit an alarm signal to the audio device to cause the audio device to emit an alarm sound.

22. The security device of claim 12, wherein the substance is a liquid, a gel, a powder, or an expanding foam.

23. The security device of claim 12, wherein the processing circuitry is further configured to, in response to receiving the gate detected signal from the radio frequency receiver, commence a timer; and wherein the processing circuitry is configured to transmit the release signal to the release mechanism in response to receiving the gate detected signal from the radio frequency receiver and the timer reaching a threshold value.

24. The security device of claim 23, wherein the processing circuitry is further configured to receive a disarm signal, and in response to receiving the disarm signal, stop the timer.

25. The security device of claim 24, wherein the locking assembly includes a switch configured to actuate into an unlocked position in association with application of a key to generate a disarm signal in response to the locking assembly transitioning into an unlocked state.

26. The security device of claim 25, wherein the switch of the locking mechanism is configured to send an alarm signal in response to actuation of the switch that is not in association with application of the key.

27. The security device of claim 24, wherein the electronic assembly comprises a second radio frequency receiver, and wherein the disarm signal is provided by the second radio frequency receiver in response to receiving a wireless disarm signal.

28. The security device of claim 24, wherein the electronic assembly further comprises an audio device; and wherein the processing circuitry is configured to:

in response to receiving the gate detected signal from the radio frequency receiver, transmit an alarm signal to the audio device to cause the audio device to emit an alarm sound; and in response to receiving the disarm signal, transmit a stop alarm signal to the audio device to cause the audio device to discontinue emitting the alarm sound.

29. A method comprising:

receiving, at processing circuitry of an electronic assembly of a security device, a gate detected signal from a radio frequency receiver of the electronic assembly in response to the radio frequency receiver receiving a wireless signal; and in response to receiving the gate detected signal from the radio frequency receiver, transmitting a release signal to a release mechanism of a benefit denial assembly to trigger the release mechanism to release a substance disposed within a vessel of the benefit denial assembly into or onto an article that is locked to the security device.

30. The method of claim 29 further comprising transmitting an alarm signal to the audio device to cause the audio device to emit an alarm sound, in response to receiving the gate detected signal from the radio frequency receiver.

31. The method of claim 30 further comprising:

commencing a timer, in response to receiving the gate detected signal from the radio frequency receiver; and wherein transmitting the release signal comprises transmitting the release signal to the release mechanism in response to receiving the gate detected signal from the radio frequency receiver and the timer reaching a threshold value.

32. The method of claim 30 wherein the substance is a liquid, a gel, a powder, or an expanding foam.

* * * * *